United States Patent [19]

Kawagishi et al.

[11] Patent Number: 4,590,153

[45] Date of Patent: May 20, 1986

[54] SILVER HALIDE COLOR PHOTOGRAPHIC MATERIALS

[75] Inventors: Toshio Kawagishi; Nobuo Furutachi, both of Kanagawa, Japan

[73] Assignee: Fuji Photo Film Co., Ltd., Kanagawa, Japan

[21] Appl. No.: 665,886

[22] Filed: Oct. 29, 1984

[30] Foreign Application Priority Data

Nov. 1, 1983 [JP] Japan ..... 58-205278

[51] Int. Cl.[4] ..... G03C 7/26

[52] U.S. Cl. ..... 430/551; 430/548; 430/558

[58] Field of Search ..... 430/551, 548, 558

[56] References Cited

U.S. PATENT DOCUMENTS

| | | | |
|---|---|---|---|
| 4,245,018 | 1/1981 | Hara et al. | 430/551 |
| 4,343,886 | 8/1982 | Nakamura et al. | 430/551 |
| 4,346,165 | 8/1982 | Sawada et al. | 430/551 |
| 4,500,630 | 2/1985 | Sato et al. | 430/558 |

FOREIGN PATENT DOCUMENTS 724427 11/1968 Belgium .

*Primary Examiner*—Mary F. Downey

*Attorney, Agent, or Firm*—Sughrue, Mion, Zinn, Macpeak, and Seas

[57] ABSTRACT

A silver halide color photographic material comprising a support having thereon at least a silver halide photographic layer, and photographic material contains (1) at least one magenta coupler containing at least one coupler moiety derived from the compound selected from the group consisting of compounds represented by following formula (I) and (2) at least one metal complex selected from the group consisting of compounds represented by following formula (II), (III), (IV) and (V):

(I)

wherein X represents a hydrogen atom or a coupling releasing group; $R^1$ represents a hydrogen atom or a substituent, Za, Zb and Zc each represents a methine group; a substituted methine group; a methylene group, a substituted methylene group, =N—, or —NH—; one of the Za-Zb bond and the Zb-Zc bond being a double bond and the other being a single bond;

(II)

(III)

(IV)

(V)

wherein

M represents Cu, Co, Ni, Pd or Pt; $R^2$, $R^3$, $R^4$ and $R^5$ each represents a hydrogen atom, a halogen atom, a hydroxy group, a cyano group, or an alkyl, aryl, cycloalkyl, or heterocyclic group each bonded to a carbon atom of the benzene ring directly or through a divalent linking group; or $R^2$ and $R^3$, $R^3$ and $R^4$, or $R^4$ and $R^5$ combine with each other to form a nonmetallic atomic group necessary for forming a 6-membered ring;

$R^6$, $R^9$ and $R^{10}$ each represents a hydrogen atom, an alkyl group, or an aryl group;

$R^7$ represents a hydrogen atom, an alkyl group, an aryl group, or a hydroxy group;

$R^8$ represents an alkyl group or an aryl group; or $R^8$ and $R^9$, or $R^9$ and $R^{10}$ combine with each other to form a nonmetallic atomic group forming a 5-, 7-, or 8-membered ring; and Y represents a nonmetallic atomic group forming a 5- or 6-membered ring.

18 Claims, No Drawings

SILVER HALIDE COLOR PHOTOGRAPHIC MATERIALS

FIELD OF THE INVENTION

This invention relates to a silver halide color photographic material containing a 5-membered-5-membered condensed nitrogen heterocyclic ring-type magenta dye image-forming coupler and a metal complex. More particularly, the invention relates to a silver halide color photographic material capable of giving color images having improved light fastness formed of a 5-membered-5-membered condensed nitrogen heterocyclic ring-type magenta dye image-forming coupler.

BACKGROUND OF THE INVENTION

It is well known that a color development of silver halide color photographic materials causes a reaction of couplers and the oxidation product of a primary aromatic amino color developing agent to form indophenol, indoaniline, indamine, azomethine, phenoxazine, phenazine, and similar dyes, whereby color images are formed. Among the couplers which are used for such silver halide color photographic materials, 5-pyrazolone couplers, cyanoacetophenone couplers, indazolone couplers, pyrazolobenzimidazole couplers, and pyrazolotriazole couplers are used for forming magenta dye images.

Couplers which have hitherto been widely used as magenta dye image-forming couplers and have been studied for use as magenta dye image-forming couplers are mostly 5-pyrazolones. It is known that dyes formed of 5-pyrazolone couplers are excellent in fastness to heat and light, but they do have an yellow component due to the existence of unnecessary absorption near 439 nm, which causes turbidity.

Various magenta dye image-forming coupler skeletones have been proposed, such as pyrazolonebenzimidazole skeletons described in U.K. Pat. No. 1,047,612; indazolone skeletons described in U.S. Pat. No. 3,770,447; and 1H-pyrazolo[3,2-c][1,2,4]triazole skeletons described in U.S. Pat. No. 3,725,067. Furthermore, 1H-imidazo[1,2-b]pyrazole skeletons described in Japanese Patent Application No. 23,434/'83 (corresponding to U.S. patent application Ser. No. 580,303); 1H-pyrazolo[1,5-b][1,2,4]triazolo skeletons described in Japanese Patent Application No. 45,512/'83 (corresponding to U.S. patent application Ser. No. 590,818); 1H-pyrazolo[1,5-d]tetrazole skeleton described in Japanese Patent Application No. 142,801/'83; and 1H-pyrazolo[1,5-b]pyrazole skeletons described in Japanese Patent Application No. 151,354/'83 have more recently been proposed.

The magenta dyes formed of the 1H-pyrazolo[3,2-c][1,2,4]triazole type couplers desxribed in U.S. Pat. No. 3,725,067; U.K. Pat. Nos. 1,252,418 and 1,334,515; the 1H-imidazo[1,2-b]pyrazole type cõuplers described in Japanese Patent Application No. 23,434/'83; the 1H-pyrazolo[1,5-b][1,2,4]triazole type couplers described in Japanese Patent Application No. 45,512/'83; the 1H-pyrazolo[1,5-d]tetrazole type couplers described in Japanese Patent Application No. 142,801/'83; and the 1H-pyrazolo[1,5-b]pyrazole type couplers described in Japanese Patent Application No. 151,354/'83 in these magenta dye image-forming couplers show excellent absorption characteristics having no unnecessary absorption in the visible wavelength region in a solvent such as ethyl acetate, dibutyl phthalate, etc.

However, the azomethine dyes formed of the 1H-pyrazolo[3,2-c][1,2,4]triazole type couplers among these couplers has very low fastness to light and greatly reduce the properties of color photographic materials, in particular color photographic materials for prints. Other 5-membered-5-membered condensed nitrogen heterocyclic ring type couples form azomethine dyes which also have unsatisfactory light fastness for use in color photographic materials, especially, in print type color photographic materials.

Hetherto, as materials for improving the light fastness of color images composed of azomethine dyes formed of 5-pyrazolone couplers, there are known hydroquinone derivatives described in U.S. Pat. Nos. 3,935,016 and 3,982,944; hydroquinone diether derivatives described in U.S. Pat. No. 4,254,216 and Japanese Patent Application (OPI) No. 21,004/'80; phenol derivatives described in Japanese Patent Application (OPI) No. 145,530/'79; spiroindane derivatives and the methylenedioxybenzene derivatives described in U.K. Patent Publication (unexamined) Nos. 2,077,455 and 2,062,888; the chroman derivatives, spirochroman derivatives, and coumaran derivatives described in U.S. Pat. Nos. 3,764,337; 3,432,300; 3,574,627; and 3,573,050; Japanese Patent Application (OPI) Nos. 152,225/'77; 20,327/'78; and 17,729/'78 (The term "OPI" used herein referes to a "published unexamined Japanese Patent Application.); the hydroquinone monoether derivatives and p-aminophenol derivatives described in Japanese Patent Application (OPI) No. 6321/'80; U.K. Pat. No. 1,347,556; U.K. Patent Publication (unexamined) No. 2,066,975; and Japanese Patent Publication No. 12,337/'79; and the bisphenol derivatives described in Japanese Patent Publication No. 31,625/'73 and U.S. Pat. No. 3,700,455.

These compounds are effective for improving the light fastness of the dye images composed of the azomethine dyes formed of 5-pyrazolone couplers, but although the compounds also show considerable effect for improving the light fastness of the color images composed of the azomethine dyes formed of 5-membered-5-membered condensed nitrogen heterocyclic ring type couplers such as 1H-pyrazolo[3,2-c][1,2,4]triazole couplers, the effect is still insufficient.

SUMMARY OF THE INVENTION

As the result of extensive investigations, it has now been discovered that a series of metal complexes can greatly improve the light fastness of the azomethine dyes formed of these couplers. These metal complexes have been described in U.S. Pat. No. 4,245,018, but the combination of these metal complexes and the foregoing couplers according to this invention has not been known, and it has surprisingly been found that the light fastness of the dye images formed of these couplers is greatly improved by the use of these metal complexes.

Also, in the case of using 5-pyrazolone magenta couplers and these metal complexes, yellow stains form by the irradiation of light or by the action of heat; however, in the case of using the combination of 5-membered-5-membered condensed nitrogen heterocyclic ring type magenta couplers and these metal complexes according to this invention, the yellow stains scarcely form, which is particularly advantageous for the properties of color photographic materials, and in particular color photographic materials for prints.

An object of this invention is, therefore, to provide a silver halide color photographic material giving magenta dye images having improved light fastness formed of 5-membered-5-membered condensed nitrogen heterocyclic ring type magenta couplers.

Another object of this invention is to provide a silver halide color photographic material giving dye images having excellent reproducibility and having excellent light fastness.

Another object of this invention is to provide a silver halide color photographic material forming no yellow stain by the action of heat or light.

Thus, according to this invention, there is provided a silver halide color photographic material containing (1) at least one magenta coupler containing at least one coupler moiety derived from the compound represented by following formula (I) and (2) at least one metal complex selected from the group consisting of compounds represented by following formula (II), (III), (IV) or (V):

(I)

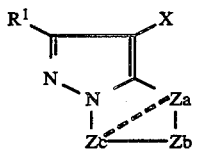

wherein X represents a hydrogen atom or a coupling releasing group; $R^1$ represents a hydrogen atom or a substituent; and Za, Zb, and Zc each represents methine group, a substituted methine group, methylene group, a substituted methylene group, =N—, or —NH—; one of the Za—Zb bond and the Zb—Zc bond being a double bond and the other being single bond.

(II)

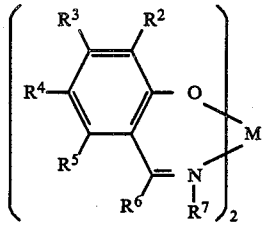

(III)

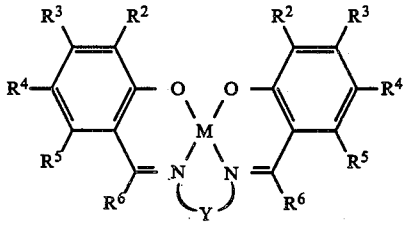

(IV)

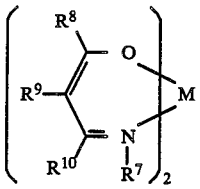

-continued (V)

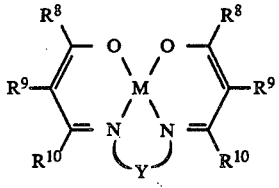

wherein M represents Cu, Co, Ni, Pd or Pt; $R^2$, $R^3$, $R^4$, and $R^5$ each represents a hydrogen atom, a halogen atom, a hydroxy group, a cyano group, an alkyl group bonded to the carbon atom of the benzene ring directly or through a divalent linkage group, an aryl group bonded to the carbon atom of the benzene ring directly or through a divalent linkage group, a cycloalkyl group bonded to the carbon atom of the benzene ring directly or through a divalent linkage group, or a heterocyclic ring group bonded to the carbon atom of the benzene ring directly or through a divalent linkage group; said $R^2$ and $R^3$, said $R^3$ and $R^4$, or said $R^4$ and $R^5$ may combine with each other to form a nonmetallic atomic group forming a 6-membered ring; $R^6$, $R^9$ and $R^{10}$ each represents a hydrogen atom, an alkyl group, or an aryl group; $R^7$ represents a hydrogen atom, an alkyl group, an aryl group, or a hydroxy group; $R^8$ represents an alkyl group or an aryl group, said $R^8$ and $R^9$ or said $R^9$ and $R^{10}$ may combine with each other to form a nonmetallic atomic group forming a 5-, 6-, 7- or 8-membered ring; and Y represents a nonmetallic group forming a 5-membered or 6-membered ring.

DESCRIPTION OF THE PREFERRED EMBODIMENT

Examples of magenta couplers used in this invention include compounds represented by the general formula (I) and polymer thereof. In the present invention the term "polymer" includes dimer and higher (than dimer) polymer, and also include compounds having chemical formulae which are obtained by combining two or more of coupler moieties derived from chemical formula (I) to form, for example, bis compounds. The polymers are formed by combination of the coupler moieties or polymerization of compounds represented by formula (I) at the position of group $R^1$, X, Za, Zb or Zc (when Za, Zb or Zc is a substituted methine group). In the coupler moieties of the polymer, $R^1$, X or substituent of Za, Zb or Zc each forms a bond, divalent linkage group or groups derived from polymerization of vinyl groups. The polymer may be a homopolymer, a copolymer obtained by using two or more compounds represented by formula (I) or a copolymer obtained by using at least one compound represented by formula (I) and a non-coloring ethylenic unsatulated monomer which are described hereinafter.

Preferred couplers in the 5-membered-5-membered condensed nitrogen heterocyclic ring type couplers shown by formula (I) are those shown by following formulae (VI), (VII), (VIII), (IX) and (X).

(VI)

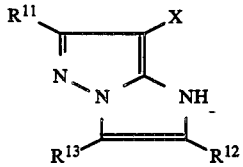

-continued

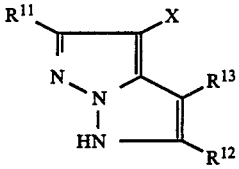

(VII)

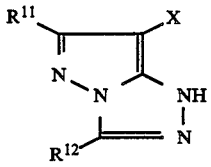

(VIII)

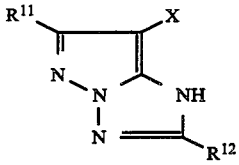

(IX)

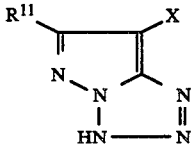

(X)

In formulae (VI), (VII), (VIII), (IX) and (X), $R^{11}$, $R^{12}$ and $R^{13}$ each preferably represents a hydrogen atom, a halogen atom, an alkyl group, an aryl group, a heterocyclic ring group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group and substituted groups thereof, and X represents a hydrogen atom, a halogen atom, a carboxy group, or a coupling releasable group bonded to the carbon atom at a coupling position through an oxygen atom, a nitrogen atom or sulfur atom; said $R^{11}$, $R^{12}$, $R^{13}$ or X may become a bond or a divalent group to form a bis compound.

Also, the coupler shown by formula (VI), (VII), (VIII), (IX) or (X) may become in the form of a polymeric coupler in which the coupler moiety derived from the couplers exists at the main chain or the side chain of the polymer and the polymer coupler induced from the vinyl monomer having the moiety derived from the formula described above is preferred. In this case, $R^{11}$, $R^{12}$, $R^{13}$ and X represent a vinyl group or a substituent having a vinyl group through a linkage group.

More particularly, $R^{11}$, $R^{12}$ and $R^{13}$ each represents a hydrogen atom, a halogen atom (e.g., a chlorine atom, a bromine atom, etc.) an alkyl group (e.g., a methyl group, a propyl group, a t-butyl group, a trifluoromethyl group, a tridecyl group, a 3-(2,4-di-t-amylphenoxy)propyl group, an allyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-t-butylphenyl group, a 2,4-di-t-amylphenyl group, a 4-tetradecanamidophenyl group, etc.), a heterocyclic ring group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-t-amylphenoxy)butylamido group, a γ-(3-t-butyl-4-hydroxyphenoxy)butylamido group, an α-{4-(4-hydroxyphenylsulfonyl)phenoxy}-decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-{α-(3-t-butyl-4-hydroxyphenoxy)-dodecanamido}anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methane-sulfonamido group, a hexadecanesulfonamido group, a benzenesulfonamido group, a p-toluenesulfonamido group, an octadecanesulfonamido group, a 2-methyloxy-5-t-butylbenzensulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-{3-(2,4-di-tert-amylphenoxy)-propyl}-carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)-sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecylcarbonyl group, an octadecylcarbonyl group, etc.), or an aryloxycarbonyl group (e.g., a phenyloxycarbonyl group, a 3-pentadecyloxycarbonyl group, etc.).

Also, X represents, practically, a hydrogen atom, a halogen atom (e.g., a chlorine atom, a bromine atom, an iodine atom, etc.), a carboxy group, a group bonding through an oxygen atom (e.g., an acetoxy group, a propanoyloxy group, a benzyloxy group, a 2,4-dichlorobenzoyloxy group, an ethoxyoxaloyloxy group, a pyruvoyl group, a cinnamoyloxy group, a phenoxy group, a 4-cyanophenoxy group, a 4-methanesulfonamidophenoxy group, a 4-methanesulfonylphenoxy group, an α-naphtoxy group, a 3-pentadecylphenoxy group, a benzyloxycarbonyloxy group, an ethoxy group, a 2-cyanoethoxy group, a benzyloxy group, a 2-phenetyloxy group, a 2-phenoxyethoxy group, a 5-phenyltetrazolyloxy group, a 2-benzothiazolyloxy group, etc.), a group bonding through a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzylethoxy-3-hydantoinyl group, a 2N-1,1-dioxo-3(2H)-oxo-1,2-benzoisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,3,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, etc.), an arylazo group (e.g., a 4-methoxyphenylazo group, a 4-pyvaloylaminophenylazo group, a 2-naphthylazo group, a 3-methyl-4-hydroxyphenylazo group, etc.), or a group bonding through a sulfur atom (e.g., a phenylthio group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, or a 2-phenyl-3-dodecyl-1,2,4-triazolyl-5-thio group, etc.).

In the coupler shown by formula (VI), $R^{12}$ and $R^{13}$ may combine with each other to form a 5-, 6- or 7-membered nonaromatic ring.

In the coupler shown by formula (VII), $R^{12}$ and $R^{13}$ may combine with each other to form 5-, 6- or 7-membered saturated, unsaturated, or aromatic ring.

When $R^{11}$, $R^{12}$, $R^{13}$ or X becomes a divalent group to form a bis compound, $R^{11}$, $R^{12}$ or $R^{13}$ preferably represents a substituted or unsubstituted alkylene group (e.g., a methylene group, an ethylene group, a 1,10-decylene group, $—CH_2CH_2—O—CH_2CH_2—$, etc.), a substituted or unsubstituted phenylene group (e.g., a 1,4-phenylene group, a 1,3-phenylene group,

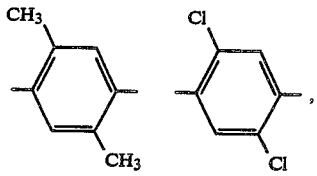

etc.), a $—NHCO—R^{14}—CONH—$ group (wherein $R^{14}$ represents a substituted or unsubstituted alkylene or phenylene group; e.g., $—NHCOCH_2CH_2CONH—$,

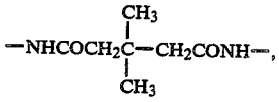

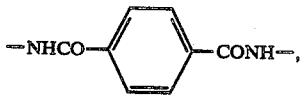

etc.), or $—S—R^{15}—S—$ group (wherein $R^{15}$ represents a substituted or unsubstituted alkylene group; e.g., $—S—CH_2CH_2—S—$,

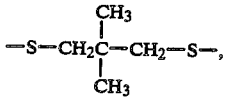

etc.); and X represents a divalent group derived from the aforesaid monovalent group.

The linkage group shown by $R^{11}$, $R^{12}$, $R^{13}$ and X when the coupler shown by formula (VI), (VII), (VIII), (IX) or (X) is included in a vinyl monomer represents a group selected from substituted or unsubstituted alkylene groups (e.g., a methylene group, an ethylene group, a 1,10-decylene group, $—CH_2CH_2OCH_2CH_2—$, etc.), phenylene groups (substituted or unsubstituted phenylene groups such as a 1,4-phenylene group, a 1,3-phenylene group,

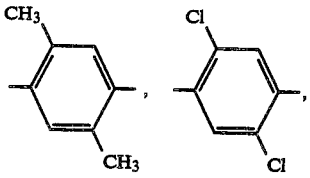

etc.), —NHCO—, —CONH—, —O—, —OCO—, and aralkylene groups (e.g.,

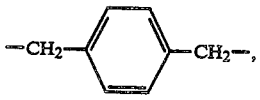

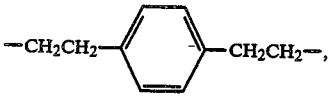

-continued

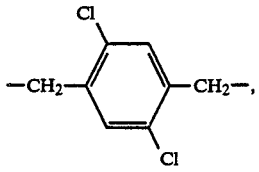

etc.) or combinations of these groups.

Preferred linkage groups include the following groups; —NHCO—, —$CH_2CH_2$—,

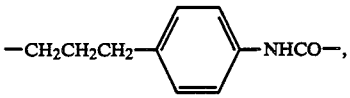

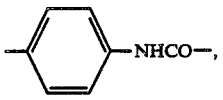

—$CH_2CH_2NHCO$—,

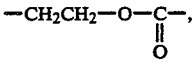

—CONH—$CH_2CH_2NHCO$—, —$CH_2CH_2O$—$CH_2CH_2$—NHCO—,

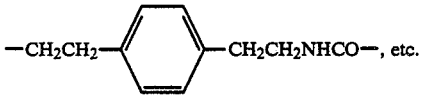

In addition, the vinyl group may have a further substituent in addition to the coupler moiety derived from formula (VI), (VII), (VIII), (IX) or (X) and the preferred substituent includes a hydrogen atom, a chlorine atom, or a lower alkyl group having 1 to 4 carbon atoms (e.g., a methyl group, an ethyl group, etc.).

Among the couplers shown by general formulae (VI), (VII), (VIII), (IX) and (X), the couplers shown by formula (VI), (VII), (IX) or (X) are preferred in this invention.

The monomer containing the coupler moiety derived from formula (VI), (VII), (VIII), (IX) or (X) may form a copolymerized polymer with non-coloring ethylenic monomer which does not cause coupling with the oxidation product of a primary aromatic amino color developing agent.

The non-coloring ethylenic monomers which do not cause coupling with the oxidation product of a primary aromatic amino developing agent include acylic acid, α-chloroacrylic acid, α-alacrylic acid (e.g., methacrylic acid, etc.), and the esters or amides induced from these acrylic acids (for example, acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, β-hydroxy methacrylate, etc.), methylenedibisacrylamide, a vinylester (e.g., vinyl acetate, vinyl propionate, vinyl laurate, etc.), acrylonitrile, methacrylonitrile, an aromatic vinyl compound (e.g., styrene and the derivatives thereof, vinyltoluene, dibutylbenzene, binylacetophenone, sulfostyrene, etc.) itaconic acid, citraconic acid, crotonic acid, vinylidene chloride, a vinyl alkyl ether (e.g., vinyl ethyl ether, etc.), maleic acid, maleic anhydride, maleic acid ester, N-vinyl-2-pyrrolidine, N-vinylpyridine, 2- or 4-vinylpyridine, etc.).

The non-coloring ethylnic unsaturated monomers may be used singly or as a mixture of two or more thereof. Examples of such combinations include n-butyl acrylate and methyl acrylate, styrene and methacrylic acid, methacrylic acid and acrylamide, methyl acrylate and diacetoneacrylamide, etc.

As is well known in the field of polymeric couplers, a non-coloring ethylenic unsaturated monomer for copolymerizing with a solid water-insoluble monomer coupler can be selected in such a manner that the copolymer formed can have preferred physical and/or chemical properties, such as with respect to the solubility thereof, the compatibility with a binder for a photographic colloid composition, such as gelatin, the flexibility and heat resistance thereof, etc. The copolymer couplers for use in this invention may be water soluble or water insoluble, and a polymer coupler latex is particularly preferred as such as polymer coupler.

Specific examples of the magenta couplers and the vinyl monomers having such coupler moieties for use in this invention are illustrated below, although the couplers in this invention are not limited thereto.

C-1

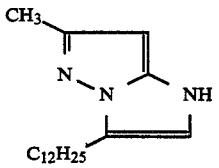

C-2

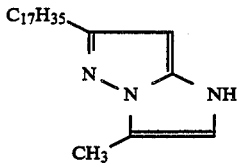

C-3

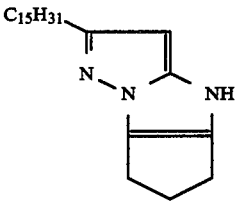

C-4

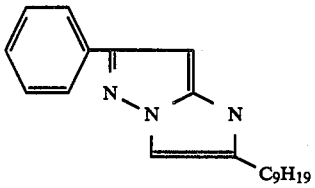

C-5

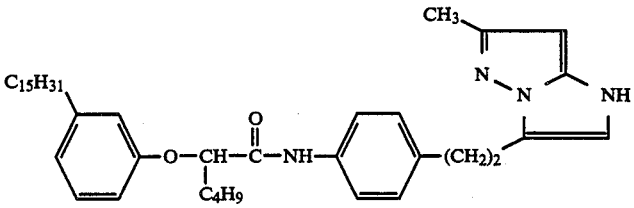

-continued
C-6
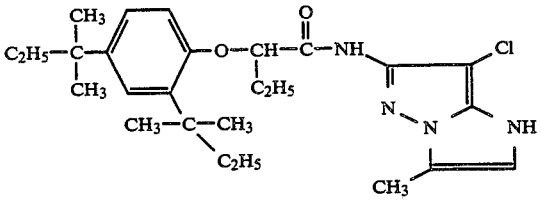
C-7
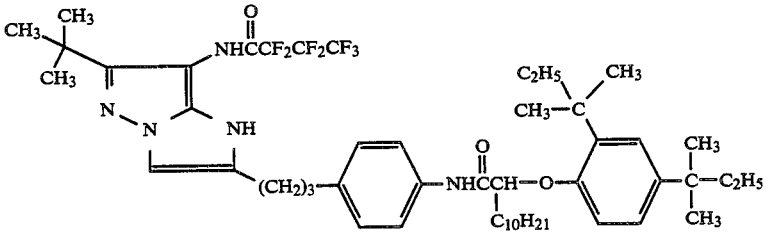
C-8
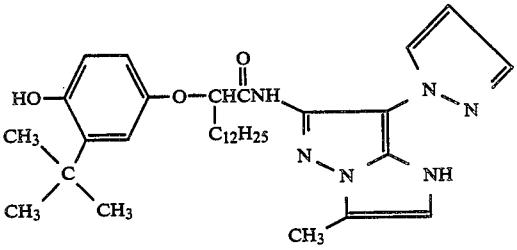
C-9
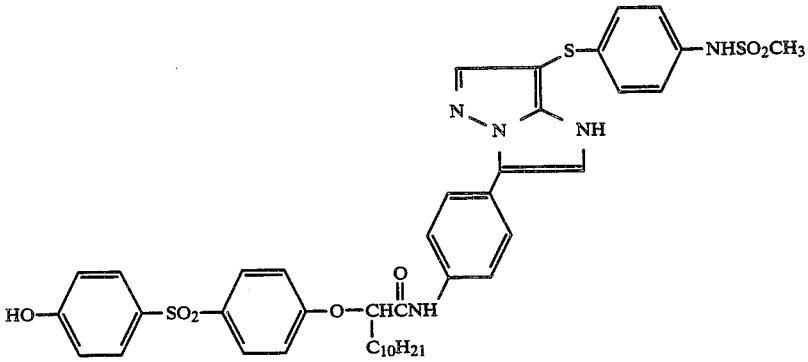
C-10
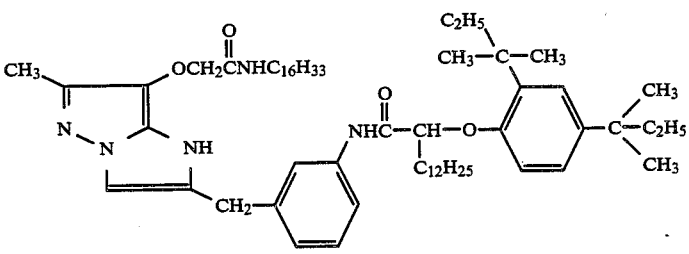
C-11
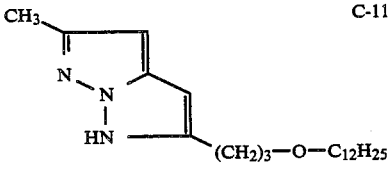
C-12
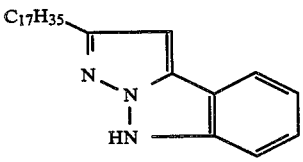
C-13
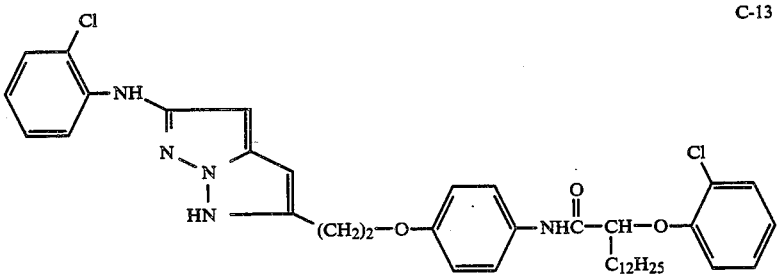

-continued
C-14
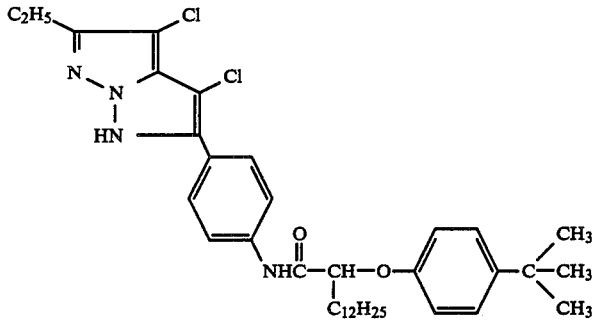
C-15
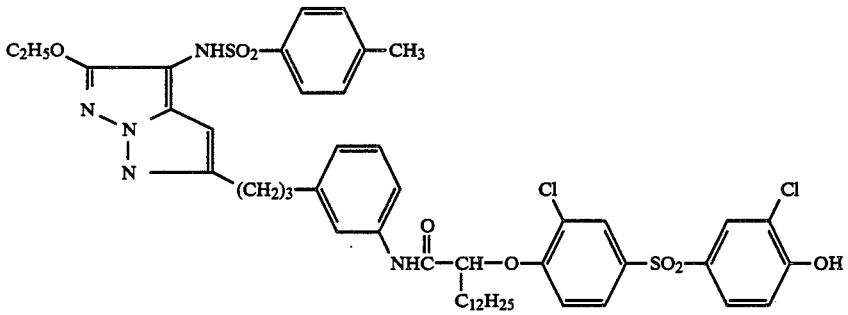
C-16
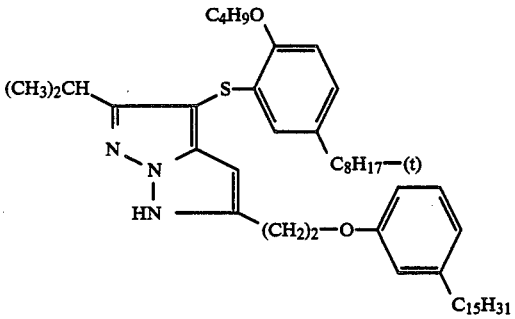
C-17
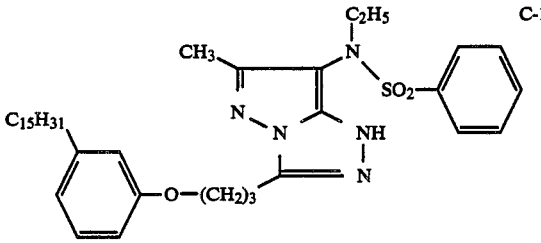
C-18
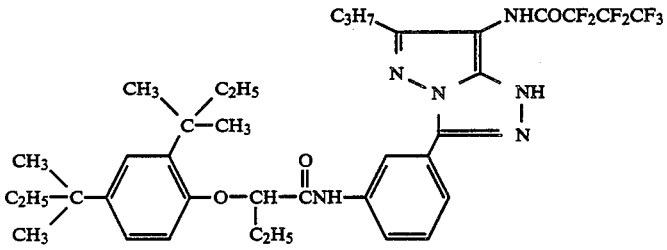
C-19
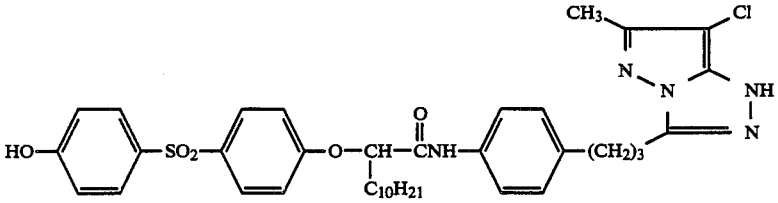

-continued
C-20
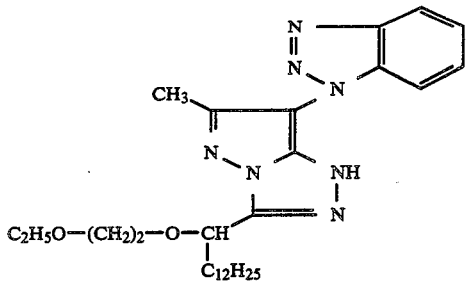
C-21
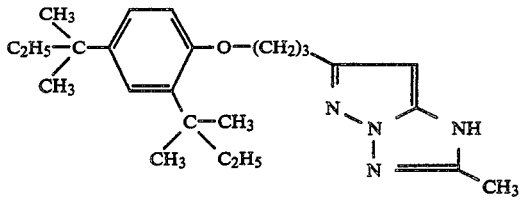
C-22
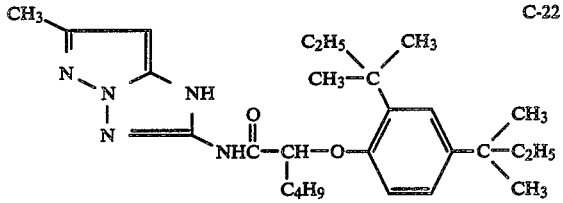
C-23
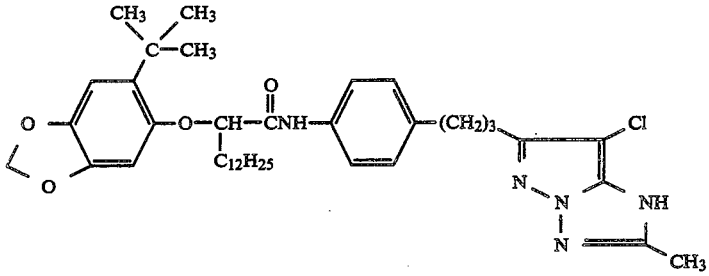
C-24
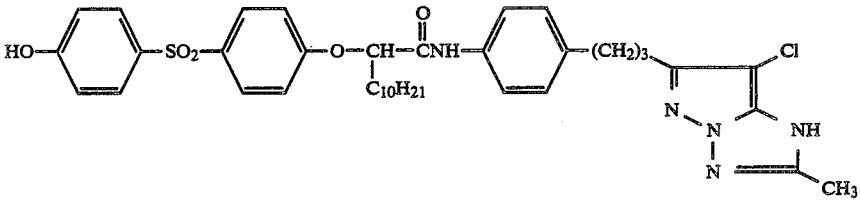
C-25
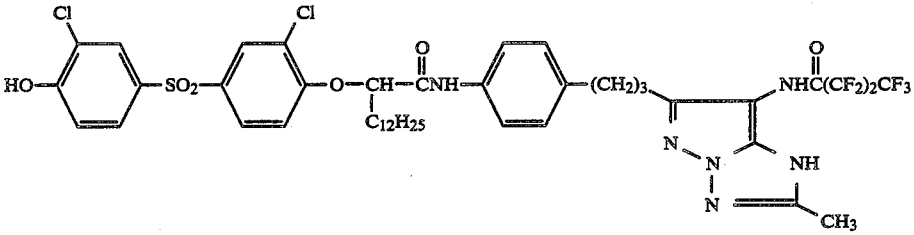
C-26
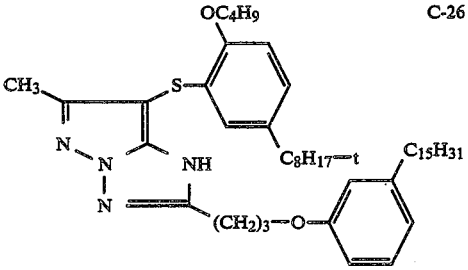
C-27
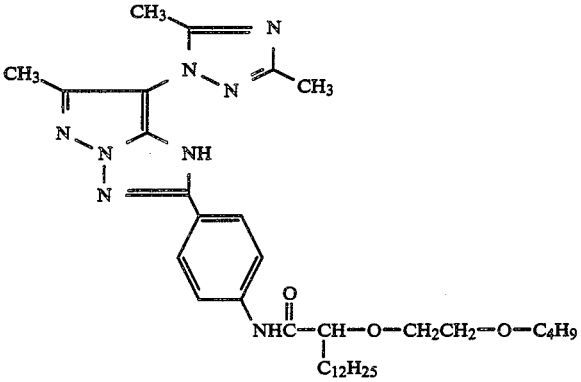

-continued
C-28
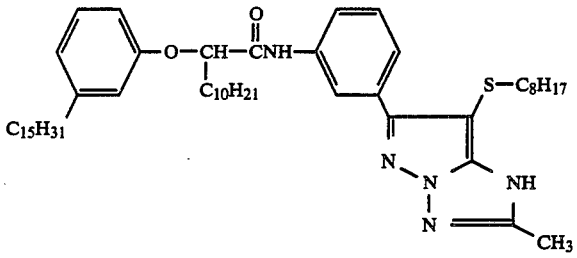
C-29
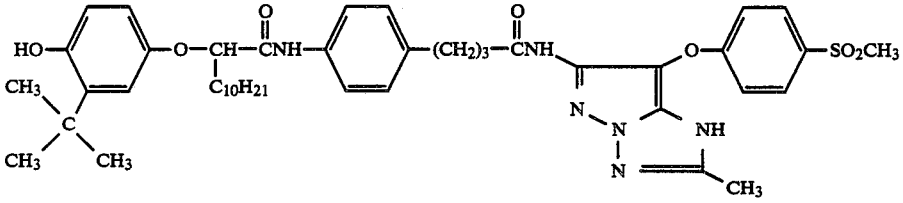
C-30
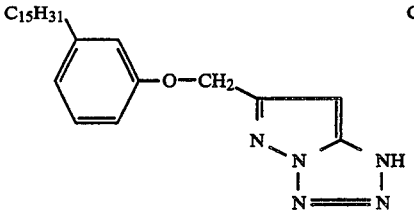
C-31
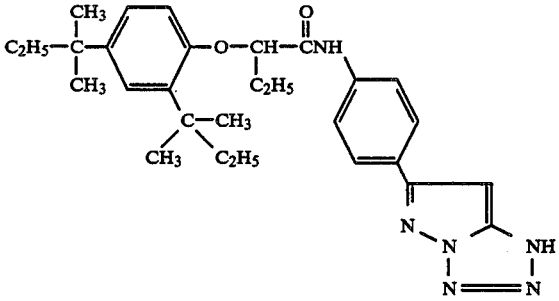
C-32
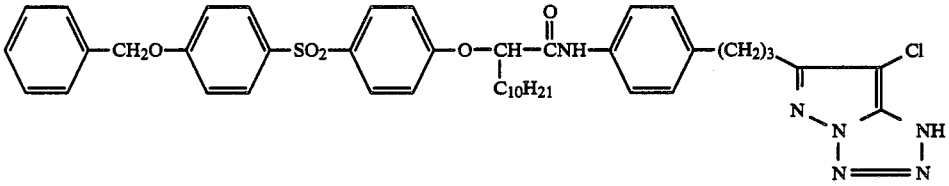
C-33
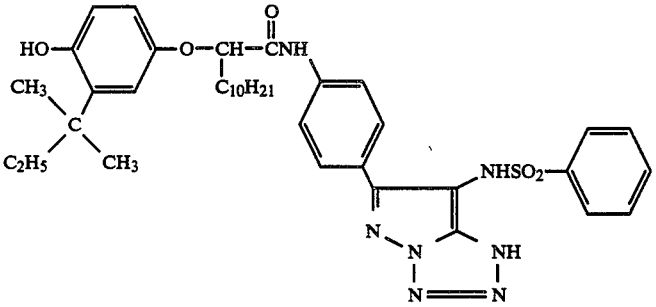
C-34
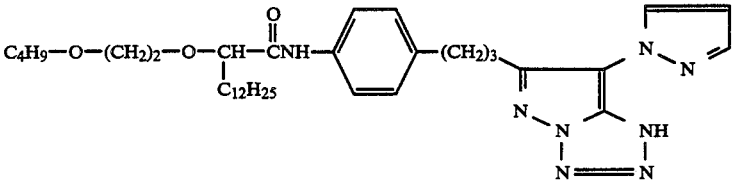

-continued
C-35
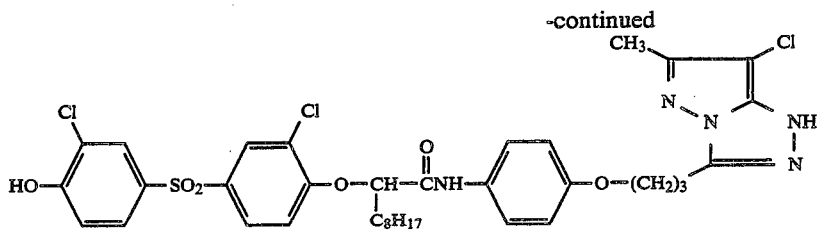
C-36
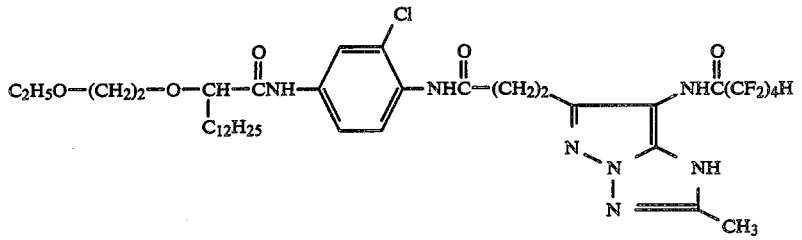
C-37
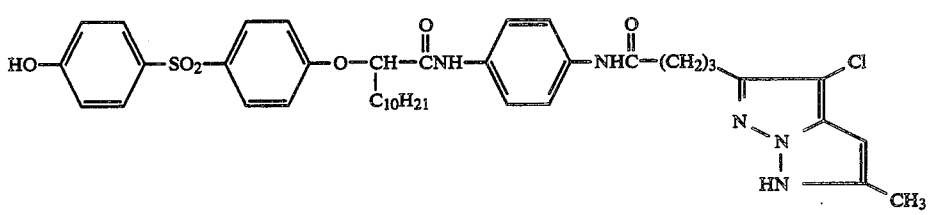
C-38
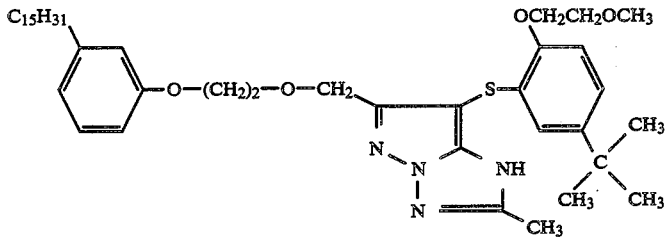
C-39
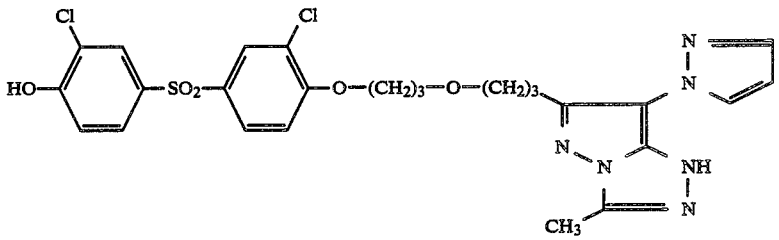
C-40
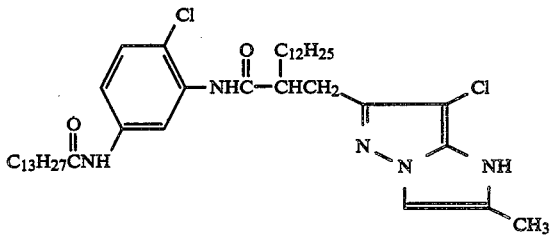
Preferred examples of monomers for polymer couplers include the following monomers.
C-41
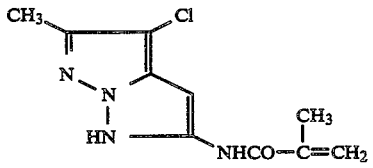
-continued -continued

C-42

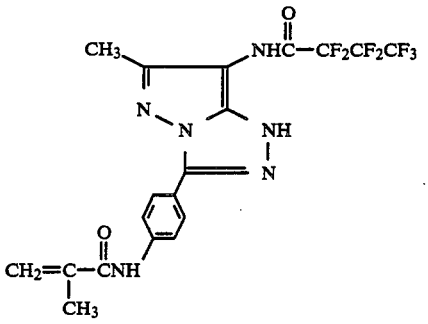

C-43

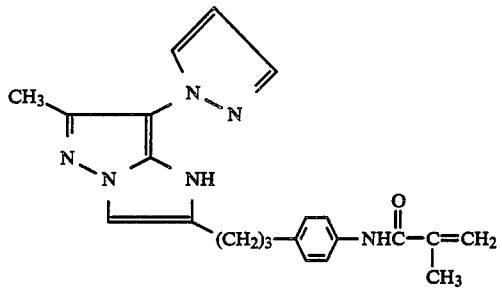

C-44

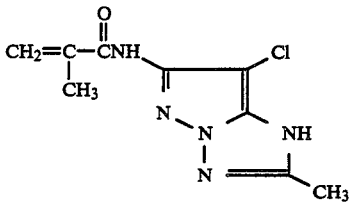

C-45

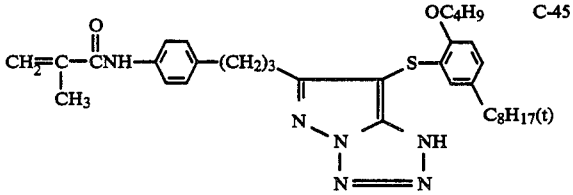

The metal complexes for use in this invention are, as described above, shown by formulae (II), (III), (IV) and (V).

(II)

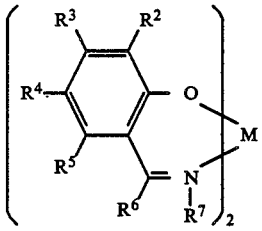

(III)

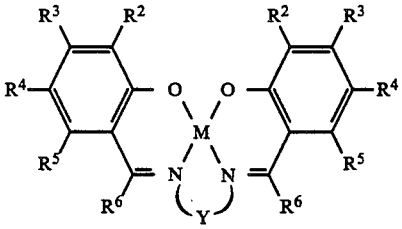

-continued (IV)

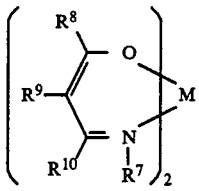

(V)

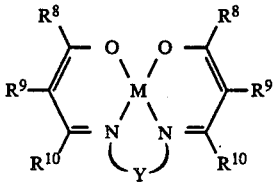

In the above formulae:

M represents Cu, Co, Ni, Pd, or Pt;

$R^2$, $F^3$, $R^4$ and $R^5$ each represents a hydrogen atom, a halogen atom, a hydroxy group, a cyano group, or an alkyl, aryl, cycloalkyl, or heterocyclic ring group each bonded to a carbon atom of the benzene ring directly or through a divalent linking group; or $R^2$ and $R^3$, $R^3$ and $R^4$, or $R^4$ and $R^5$ may combine with each other to form a non-metallic atomic group forming a 6-membered ring;

$R^6$, $R^9$, and $R^{10}$ each represents a hydrogen atom, an alkyl group, or an aryl group;

$R^7$ represents a hydrogen atom, an alkyl group, an aryl group, or a hydroxy group;

$R^8$ represents an alkyl group or an aryl group, said $R^8$ and $R^9$ or said $R^9$ and $R^{10}$ may combine with each other to form a non-metallic atomic group necessary for forming a 5-, 6-, 7-, or 8-membered ring; and Y represents a non-metallic atomic group forming a 5-membered or 6-membered ring.

The halogen atoms represented by $R^2$, $R^3$, $R^4$ and $R^5$ include a fluorine atom, a chlorine atom, a bromine atom, and an iodine atom.

The alkyl group represented by $R^2$, $R^3$, $R^4$ and $R^5$ is preferably an alkyl group having from 1 to 19 carbon atoms, which may be a straight or branched chain alkyl or may be unsubstituted or substituted. The aryl group represented by $R^2$, $R^3$, $R^4$ and $R^5$ is preferably an aryl group having from 6 to 14 carbon atoms, which may be unsubstituted or substituted. The heterocyclic ring group represented by $R^2$, $R^3$, $R^4$ and $R^5$ is preferably a 5-membered or 6-membered heterocyclic ring, which may be unsubstituted or substituted. Also, the cycloalkyl group shown by $R^2$, $R^3$, $R^4$ and $R^5$ is preferably a 5-membered or 6-membered ring group, which may be unsubstituted or substituted.

$R^2$ and $R^3$, $R^3$ and $R^4$, and said $R^4$ and $R^5$ may combine with each other to form a 6-membered ring, such as preferably a benzene ring, which may be unsubstituted or substituted, or which may be condensed.

The straight or branched chain alkyl group represented by $R^2$, $R^3$, $R^4$ and $R^5$ includes, for example, a methyl group, an ethyl group, a propyl group, a butyl group, a hexyl group, an octyl group, a decyl group, a dodecyl group, a tetradecyl group, a hexadecyl group, an octadecyl group, etc.

The aryl group shown by $R^2$, $R^3$, $R^4$ and $R^5$ includes, for example, a phenyl group, a naphthyl group, etc.

The heterocyclic ring group represented by $R^2$, $R^3$, $R^4$ and $R^5$ is a 5-membered or 6-membered heterocyclic ring group including at least one nitrogen atom, oxygen atom or sulfur atom in the ring, such as, for example, a furyl group, a hydrofuryl group, a thienyl group, a pyrrolyl group, a pyrrolidyl group, a pyridyl group, an imidazolyl group, a pyrazolyl group, a quinolyl group, an indolyl group, an oxazolyl group, a thiazolyl group, etc.

The cycloalkyl group shown by $R^2$, $R^3$, $R^4$ and $R^5$ includes, for example, a cyclopentyl group, a cyclohexyl group, a cyclohexenyl group, a cyclohexedienyl group, etc.

Examples of the 6-membered ring formed by the combination of $R^2$ and $R^3$, $R^3$ and $R^4$, or $R^4$ and $R^5$ are a benzene ring, a naphthalene ring, an isobenzothiophene ring, an isobenzofuran ring, an isoindoline ring, etc.

The above described alkyl group, cycloalkyl group, aryl group or heterocyclic ring group represented as examples of $R^2$, $R^3$, $R^4$ or $R^5$ may be bonded to the carbon atom of the benzene ring through a divalent linking group such as an oxy (—O—) group, a thio (—S—) group, a divalent linking group derived from an amino group, a carbamoyl group, a sulfamoyl group, or a carbonylamino group, an oxycarbonyl group, a carbonyl group, a sulfonyl group, a carbonyloxy group, etc.

Examples of the case wherein the alkyl group is bonded to the carbon atom of the benzene ring through a divalent linking group include an alkoxy group (e.g., a methoxy group, an ethoxy group, a butoxy group, a propoxy group, an n-decyloxy group, an n-dodecyloxy group, an n-hexadecyloxy group, etc.), an alkoxycarbonyl group (e.g., a methoxycarbonyl group, an ethoxycarbonyl group, a butoxycarbonyl group, an n-decyloxycarbonyl group, an n-hexadecyloxycarbonyl group, etc.), an acyl group (e.g., an acetyl group, a valeryl group, a stearoyl group, a benzoyl group, a toluoyl group, etc.), an acyloxy group (e.g., an acetoxy group, a hexadecylcarbonyloxy group, etc.), an alkylamino group (e.g., a n-butylamino group, an N,N-diethylamino group, an N,N-didecylamino group, etc.), an alkylcarbamoyl group (e.g., a butylcarbamoyl group, an N,N-diethylcarbamoyl group, a n-dodecylcarbamoyl group, etc.), an alkylsulfamoyl group, (e.g., a butylsulfamoyl group, an N,N-diethylsulfamoyl group, a n-dodecylsulfamoyl group, etc.), a sulfonylamino group (e.g., a methylsulfonylamino group, a butylsulfonylamino group, etc.), a sulfonyl group (e.g., a mesyl group, an ethanesulfonyl group, etc.), and an acylamino group (e.g., an acetylamino group, a valerylamino group, a palmitoylamino group, a benzoylamino group, a toluoylamino group, etc.).

Examples of the case wherein the cycloalkyl group bonded to the carbon atom of the benzene ring through the foregoing divalent linkage group are a cyclohexyloxy group, a cyclohexylcarbonyl group, a cyclohexyloxycarbonyl group, a cyclohexylamino group, a cyclohexenylcarbonyl group, a cyclohexenyloxy group, etc.

Examples of the case that the aryl group bonded to the carbon atom of the benzene ring are an aryloxy group (e.g., a phenoxy group, a naphtoxy group, etc.), an aryloxycarbonyl group (e.g., a phenoxycarbonyl group, a naphthoxycarbonyl group, etc.), an acyl group (e.g., a benzoyl group, a naphthoyl group, etc.), an anilino group (e.g., a phenylamino group, an N-methylanilino group, an N-acetylanilino group, etc.), an acyloxy group (e.g., a benzoyloxy group, a toluoyloxy group, etc.), an arylcarbamoyl group (e.g., a phenylcarbamoyl group, etc.), an arylsulfamoyl group (e.g., a phenylsulfamoyl group, etc.), an arylsulfonylamino group (e.g., a phenylsulfonylamino group, a p-tolylsulfonylamino group, etc.), an arylsulfonyl group (e.g., a benzenesulfonyl group, a tosyl group, etc.), and an acylamino group (e.g., a benzoylamino group, etc.).

The alkyl group, the aryl group, the heterocyclic ring group and the cycloalkyl group represented by $R^2$, $R^3$, $R^4$ and $R^5$ or the 6-membered ring formed by the combination of $R^2$ and $R^3$, $R^3$ and $R^4$, or $R^4$ and $R^5$ may be substituted by a halogen (e.g., a chlorine atom, a bromine atom, or a fluorine atom), a cyano group, a straight or branched chain alkyl group (e.g., a methyl group, an ethyl group, a propyl group, a butyl group, a hexyl group, an octyl group, a decyl group, a dodecyl grpup, a tetradecyl group, a hexadecyl group, a heptadecyl group, an octadecyl group, a methoxyethoxyethyl group, etc.), an aryl group (e.g., a phenyl group, a tolyl group, a naphthyl group, a chlorophenyl group, a methoxyphenyl group, an acetylphenyl group, etc.), an alkoxy group (e.g., a methoxy group, an ethoxy group, a butoxy group, a propoxy group, a methoxyethoxy group, etc.), an aryloxy group (e.g., a phenoxy group, a tolyloxy group, a naphthoxy group, a methoxyphenoxy group, etc.), an alkoxycarbonyl group (e.g., a methoxycarbonyl group, a butoxycarbonyl group, a phenoxymethoxycarbonyl group, etc.), an aryloxycarbonyl group (e.g., a phenoxycarbonyl group, a tolyoxycarbonyl group, a methoxyphenoxycarbonyl group, etc.), an acyl group (e.g., a formyl group, an acetyl group, a valeryl group, a stearoyl group, a benzoyl group, a toluoyl group, a naphthoyl group, a p-methoxybenzyl group, etc.), an acyloxy group (e.g., an acetoxy group, an acyloxy group, etc.), an acylamino group (e.g., an acetamido group, a benzamido group, a methoxyacetamido group, etc.), an anilino group (e.g., a phenylamino group, an N-methylanilino group, an N-phenylanilino group, an N-acetylanilino group, etc.), an alkylamino group (e.g., a n-butylamino group, an N,N-diethylamino group, a 4-methoxy-n-butylamino group, etc.), a carbamoyl group (e.g., a n-butylcarbamoyl group, an N,N-diethylcarbamoyl group, a n-butylsulfamoyl group, an N,N-diethylsulfamoyl group, a n-dodecylsulfamoyl group, an N-(4-methoxy-n-butyl)sulfamoyl group, etc.), a sulfonylamino group (e.g., a methylsulfonylamino group, a phenylsulfonylamino group, a methoxymethylsulfonylamino group, etc.), or a sulfonyl group (e.g., a mesyl group, a tosyl group, a methoxymethanesulfonyl group, etc.).

The alkyl group represented by $R^6$, $R^7$, $R^8$, $R^9$ or $R^{10}$ includes unsubstituted or substituted alkyl groups which may be straight or branched chain alkyl group. These alkyl group have from 1 to 20 carbon atoms, excluding the carbon atoms of substituents, and examples of these alkyl groups are a methyl group, an ethyl group, a propyl group, a butyl group, a hexyl group, an octyl group, a decyl group, a dodecyl group, a tetradecyl group, a hexadecyl group, a heptadecyl group, or an octadecyl group, etc.

Also, the aryl group represented by $R^6$, $R^7$, $R^8$, $R^9$ and $R^{10}$ includes an unsubstituted aryl group or substituted aryl group. The aryl group preferably has from 6 to 14 carbon atoms, excluding the carbon atoms of the substituent. Examples thereof include a phenyl group, a tolyl group, and a naphthyl group.

The nonmetallic atomic groups represented by Y forming a 5-membered or 6-membered ring includes the nonmetallic atomic groups represented by following formulae (a), (b), (c), (d) and (e);

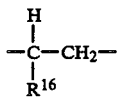
(a)

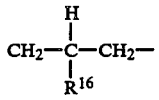
(b)

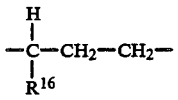
(c)

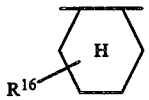
(d)

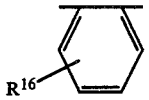
(e)

wherein $R^{16}$ represents a hydrogen atom or an alkyl group.

The alkyl group represented by $R^{16}$ includes both substituted alkyl groups and unsubstituted alkyl groups and an alkyl group having from 1 to 20 carbon atoms excluding the carbon atoms of the substituent moiety, is preferred. The alkyl group may be a straight or branched chain alkyl. Practical examples of the alkyl groups include the practical examples of the alkyl groups illustrated above in regard to $R^2$, $R^3$, $R^4$ and $R^5$.

Preferred examples of the metal complexes represented by aforesaid formulae (II), (III), (IV) or (V) are those represented by following formulae (IIa), (IIb), (IIIa), (IVa), (IVb) and (Va).

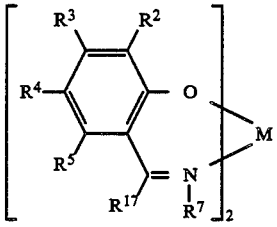
(IIa)

(wherein $R^{17}$ represents an alkyl group or an aryl group)

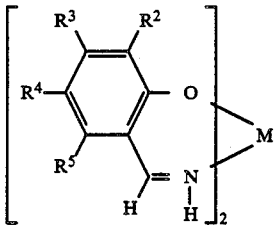
(IIb)

-continued

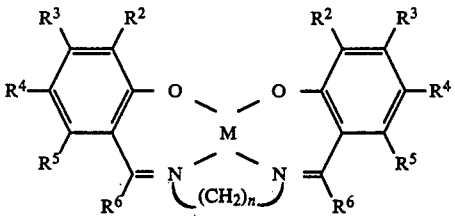
(IIIa)

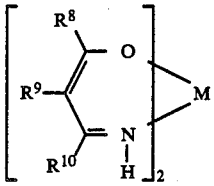
(IVa)

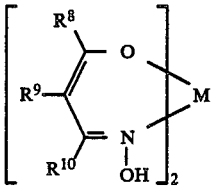
(IVb)

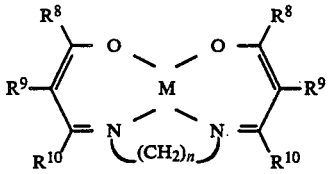
(Va)

Particularly preferred metal complexes among the complexes represented by above formulae (IIa), (IIb), (IIIa), (IVa), (IVb), and (Va) are the complexes represented by formulae (IIa), (IIb), and (IIIa). In the more preferred metal complexes shown by formulae (IIa), (IIb) and (IIIa), $R^2$ is a group capable of causing hydrogen bonding; at least one of $R^3$, $R^4$ and $R^5$ is a hydrogen atom, a hydroxy group, an alkyl group, or an alkoxy group; and the total carbon number of the groups represented by $R^2$, $R^3$, $R^4$, $R^5$, $R^6$ and $R^7$ is at least 4.

The group represented by $R^2$ capable of causing hydrogen bonding includes an oxy group-containing group (e.g., a methoxy group, an ethoxy group, a propoxy group, a butoxy group, a n-octyloxy group, a 2-ethylhexyloxy group, a decyloxy group, a n-dodecyloxy group, a 2-hexyldecyloxy group, an isostearyloxy group, a benzyloxy group, a piperonyloxy group, a phenoxy group, a trimethylsilyloxy group, etc.), a thio group-containing group (e.g., a methylthio group, an ethylthio group, a propylthio group, a butylthio group, a 2-ethylhexylthio group, a n-dodecylthio group, a 2-hexyldecylthio group, an isostearylthio group, a substituted or unsubstituted phenylthio group, etc.), a carbonyl group-containing group (e.g., an acetyl group, a propionyl group, a butyryl group, a hexanoyl group, an octanoyl group, a stearoyl group, a benzoyl group, etc.), an oxycarbonyl group-containing group (e.g., a methoxycarbonyl group, an ethoxycarbonyl group, a butoxycarbonyl group, a n-decyloxycarbonyl group, a stearyloxycarbonyl group, a phenoxycarbonyl group, etc.), a carbamoyl group (e.g., a methylcarbamoyl group, an ethylcarbamoyl group, a butylcarbamoyl group, an N,N-diethylcarbamoyl group, a n-dodecylcarbamoyl group, a phenylcarbamoyl group, etc.), a sulfamoyl group (e.g., a methylsulfamoyl group, an N,N-diethylsulfamoyl group, a butylsulfamoyl group, a n-dodecylsulfamoyl group, a phenylsulfamoyl group, etc.), a sulfonyl group-containing group (e.g., a mesyl group, an ethanesulfonyl group, a benzenesulfonyl group, a tosyl group, etc.), a sulfonylamino group (e,.g., a methylsulfonyl amino group, a butylsulfonylamino group, etc.), an acylamino group (e.g., an acetylamino group a benzoylamino group, etc.), a carbonyloxy group-containing group (e.g., an acetoxy group, a butylyoxy group, a benzoyloxy group, etc.), an amino group (e.g., a —$NH_2$ group, a methylamino group, a diethylamino group, a dibutylamino group, a hexylamino group, a benzylamino group, an anilino group, etc.), a hydroxyl group, a nitro group, a cyano group, a carboxylic acid group, a sulfonic acid group, or a halogen atom.

Specific examples of the metal complexes represented by foregoing formulae (II), (III), (IV), and (V) effective for the practice of this invention are illustrated below, although the complexes useful in this invention are not limited to these compounds.

M-1

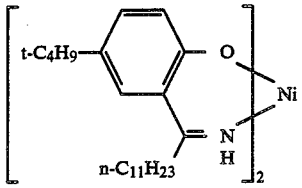

M-2

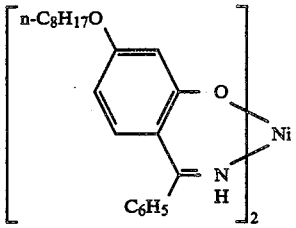

M-3

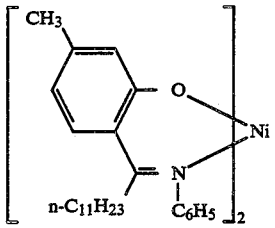

M-4

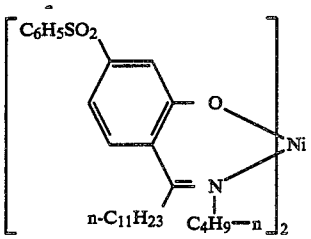

-continued

M-5

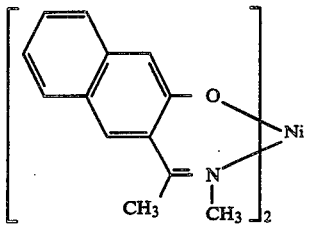

M-6

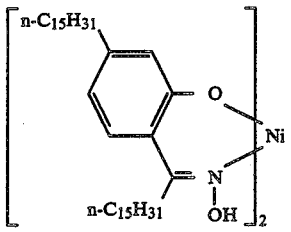

M-7

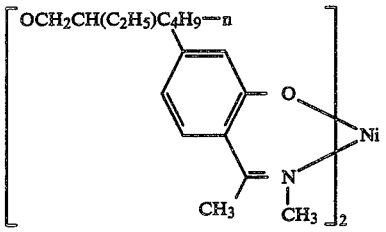

M-8

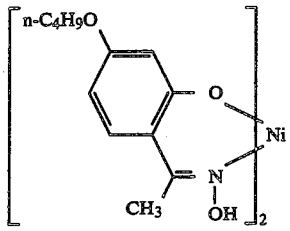

M-9

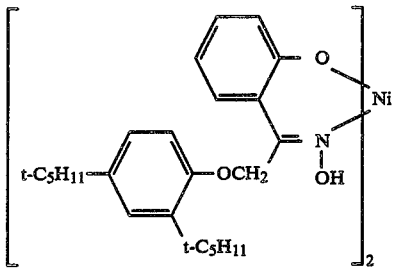

M-10

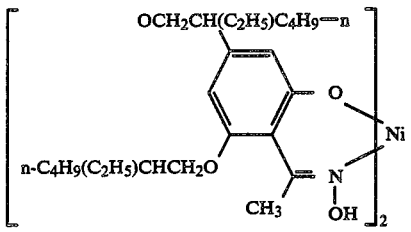

-continued
M-11
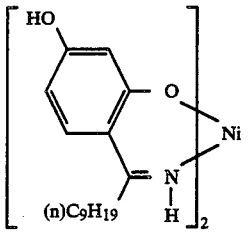
M-12
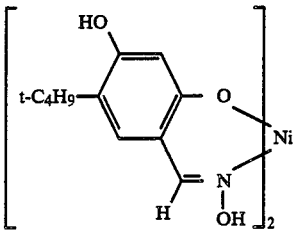
M-13
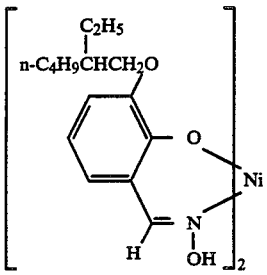
M-14
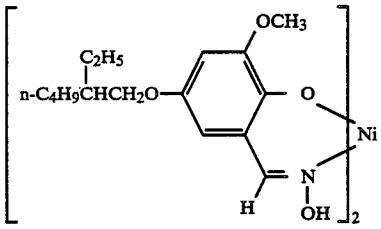
M-15
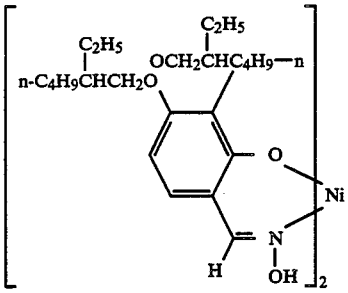
M-16
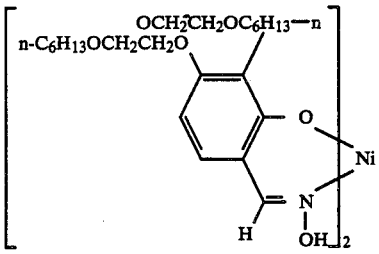
-continued
M-17
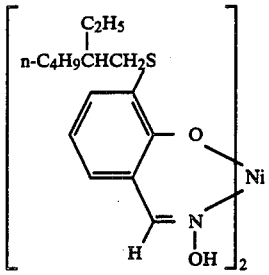
M-18
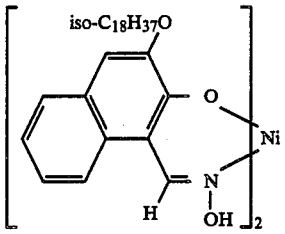
M-19
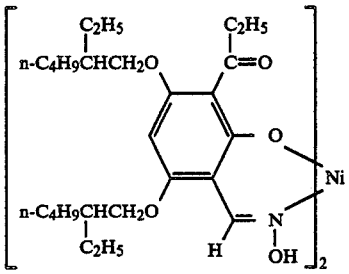
M-20
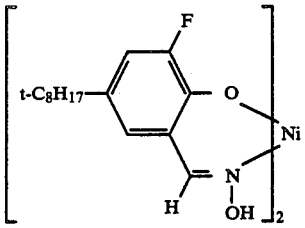
M-21
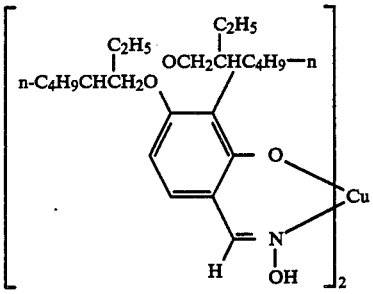
M-22
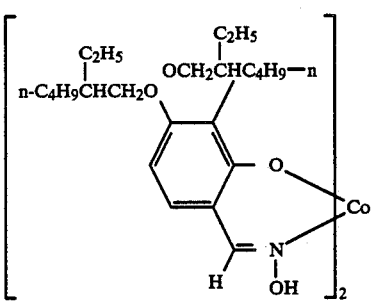

-continued
M-23
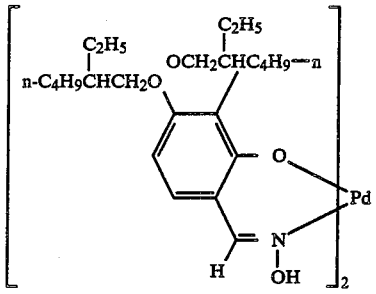
M-24
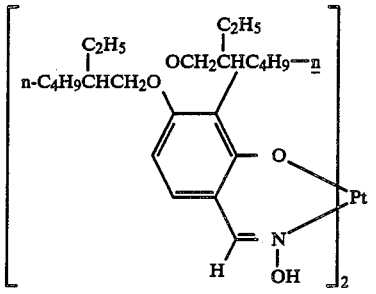
M-25
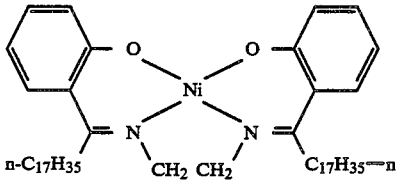
M-26
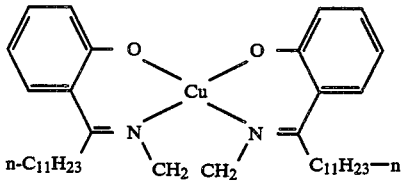
M-27
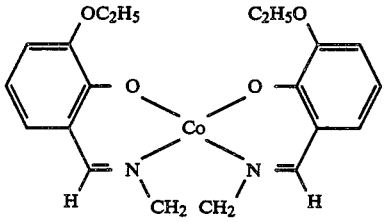
M-28
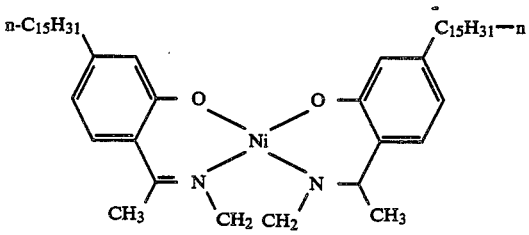
-continued
M-29
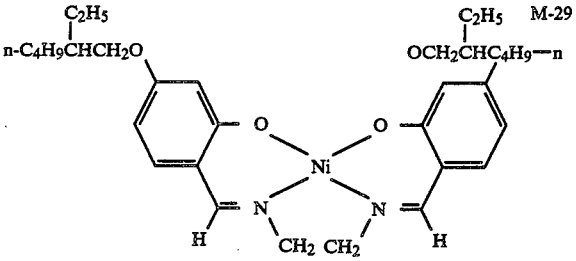
M-30
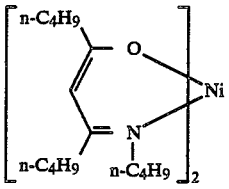
M-31
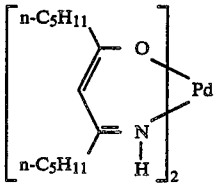
M-32
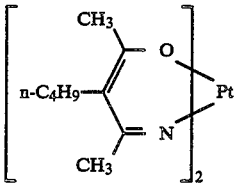
M-33
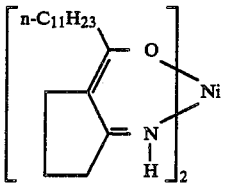
M-34
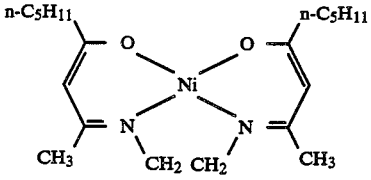
M-35
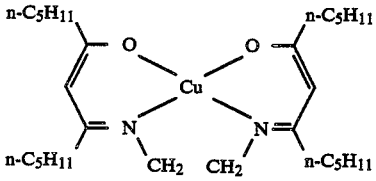
M-36
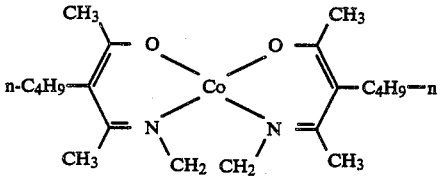

-continued

M-37

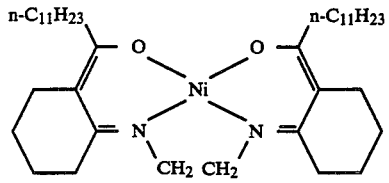

M-38

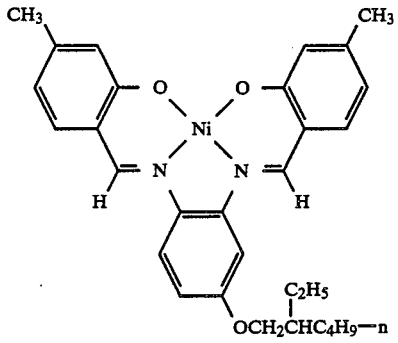

M-39

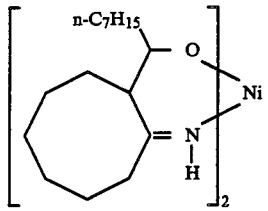

M-40

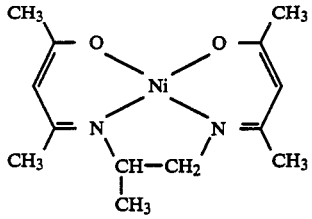

The coupler in this invention is added to a silver halide emulsion generally in an amount of from $2\times10^{-3}$ mole to $5\times10^{-1}$ mole, and preferably from $1\times10^{-2}$ mole to $5\times10^{-1}$ mole, per mole of silver in the emulsion. It is generally preferred that the magenta coupler in this invention be incorporated in a green-sensitive silver halide emulsion layer, but the coupler may be incorporated in other silver halide emulsion layer or layers or interlayers.

The metal complex in this invention is incorporated in the photographic material generally in an amount of from 1 to 100 mole%, and preferably from 5 to 40 mole%, based on the mole of the coupler. The metal complex is preferably incorporated in a layer containing the magenta coupler.

For incorporating couplers including the magenta coupler in this invention in silver halide emulsion layers, known methods, such as the method described, for example, in U.S. Pat. No. 2,322,027 can be used. For example, the coupler is dissolved in a high-boiling organic solvent such as a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkyl amide (e.g., diethyl laurylamide, etc.), a fatty acid ester (e.g., dibutoxyethyl succinate, dioctyl azelate, etc.), a trimesic acid ester (e.g., tributyl trimesate, etc.), or a low-boiling organic solvent having a boiling point of from about 30° C. to 150° C., a lower alkyl acetate (e.g., ethyl acetate, butyl acetate, etc.), ethyl propionate, secondary butyl alcohol, methyl isobutyl ketone, β-ethoxyethyl acetate, methyl cellosolve acetate, etc., and then the solution of the coupler is dispersed in an aqueous solution of a hydrophilic colloid. A mixture of the foregoing high-boiling organic solvent and the low-boiling organic solvent can also be used. Also, the dispersing method by the polymer as described in Japanese Patent Publication No. 39,853/'76 and Japanese Patent Application (OPI) No. 59,943/'76 can be used.

When the coupler has an acid group such as a carboxylic acid group and a sulfonic acid group, the coupler is introduced in an aqueous solution of a hydrophilic colloid as an alkaline aqueous solution.

As a binder for silver halide photographic emulsions or as the protective colloid, gelatin is advantageously used but hydrophilic colloids other than gelatin may also be used. Examples of such hydrophilic colloids are gelatin derivatives; graft polymers of gelatin and other high molecular weight compounds; proteins such as albumin, casein, etc.; cellulose derivatives such as hydroxyethyl cellulose, carboxymethyl cellulose, cellulose sulfuric acid esters, etc.; sugar derivatives such as sodium alginate, starch derivatives, etc.; and various synthetic hydrophilic polymers such as homopolymers or copolymers of vinyl alcohol, vinyl alcohol partial acetal, N-vinylpyrrolidone, acrylic acid, methacrylic acid, acrylamide, vinyl imidazole, vinyl pyrazole, etc.

As gelatin, limed gelatin, acid-treated gelatin, and the enzyme-treated gelatin as described in *Bull. Soc. Photo. Japan,* No. 16, 30 (1966), as well as the hydrolyzed products and enzyme decomposed products of gelatin can be used. Also, as gelatin derivatives, materials obtained by reacting gelatin and various compounds such as acid halides, acid anhydrides, isocyanates, bromoacetates, alkanesultones, vinylsulfonamides, maleinimide compounds, polyalkylene oxides, epoxy compounds, etc., can be used.

For the silver halide photographic layers of the silver halide color photographic materials of this invention, silver bromide, silver iodobromide, silver iodochlorobromide, silver chlorobromide, or silver chloride may be used as the silver halide. The preferred silver halide is silver iodobromide containing less than 15 mole% silver iodide. The particularly preferred silver halide is silver iodobromide containing from 2 mole% to 12 mole% silver iodide.

The silver halide grain in the silver halide emulsion for use in this invention may have a regular crystal form such as a cubic form, a octahedral form, may have an irregular form such as a spherical form, a tubular form, etc., or may have a composite form of these crystal forms. Furthermore, the silver halide grain may be composed of a mixture of silver halide grains having various crystal forms.

There is no particular restriction on the grain size of the silver halide grains in the silver halide emulsion but is grain size is preferably less than 3 microns (in the case of a silver halide grain of a spherical form or a form similar to spherical, the diameter of the grain is used as the grain size; in the case of the silver halide grain of a cubic form, the length of the side is used as the grain size, and the grain size is determined by the mean value based on the projected areas).

The grain size distribution of the silver halide may be broad or narrow.

Also, silver halide grains wherein silver halide grains having a length/thickness value higher than 8 exist in a proportion of higher than 50% of the total projected area are preferably used.

The silver halide grains for use in this invention may have different phases between the inside thereof and the surface portion thereof or may have a homogeneous phase throughout the grain. Also, the silver halide grain may be a grain mainly forming a latent image on the surface thereof or a grain mainly forming a latent image in the inside thereof.

The silver halide photographic emulsions for use in this invention can be prepared by methods as described in P. Glafkides, *Chimie et Phisique Photographique,* published by Paul Montel, 1967; G. F. Duffin, *Photographic Emulsion Chemistry* (published by The Focal Press, 1966); and V. L. Zelikman et al, *Making and Coating Photographic Emulsion,* published by The Focal Press, 1964. That is, the silver halide photographic emulsions may be prepared by an acid method, a neutralization method, an ammonia method, etc., and for reacting a soluble silver salt and a soluble halide, a one-side mixing method, a simultaneous mixing method, or a combination of these methods can be used.

Furthermore, a so-called back mixing method, in which silver halide grains are formed in the presence of excessive silver ions, can be used. As a system of the simultaneous mixing method, a so-called controlled double jet method in which the pAg in a liquid phase forming silver halide is maintained at a constant value can be also used. According to the method, a silver halide meulsion wherein the crystal form of the silver halide is regular and the grain sizes are almost uniform can be obtained.

Furthermore, the silver halide emulsion for use in this invention may be prepared by mixing two or more silver halide emulsions which have each been formed separately.

During the formation of silver halide grains or physical ripening of silver halide emulsions, a cadmium salt, a zinc salt, a lead salt, a thallium salt, an iridium salt or a complex salt thereof, a rhodium salt or a complex salt thereof, an iron salt or a complex salt thereof, etc., may exist in the system.

Silver halide emulsions are usually chemically sensitized. For the chemical sensitization, methods as described, for example, in H. Frieser, editor, *Die Grundlagen der Photographischen Prozess mit Silberhalogeniden,* published by Akademische Verlagsgesellschaft, 1968, pages 675–735, can be used.

Particularly, such methods include a sulfur sensitization method using an active gelatin or a compound containing sulfur capable of reacting with silver (e.g., a thiosulfate, a thiourea, a mercapto compound, a rhodanine, etc.); a reduction sensitizing method using a reducing material (e.g., a stanous salt, an amine, a hydrazine derivative, formamidine-sulfinic acid, a silane compound, etc.); and a noble metal sensitization method using a noble metal compound (e.g., a gold complex salt and complex salts of metals belonging to the group VIII of the periodic table, such as Pt, Ir, Pd, etc.), and these methods may be used singly or as a combination thereof.

The silver halide photographic emulsions for use in this invention may contain various compounds for preventing the formation of fog during the production, storage or photographic processing of the silver halide photographic materials or for stabilizing the photographic properties of the silver halide photographic materials. As such compounds, there are many compounds known as antifoggants or stabilizers, such as benzothiazolium, nitroindazoles, triazoles, benzotriazoles, benzimidazoles (in particular, the nitro-substituted materials or the halogen-substituted materials), heterocyclic mercapto compounds such as mercaptothiazoles, mercaptobenzothiazoles, mercaptobenzimidazoles, mercaptothiadiazole, mercaptotetrazoles (in particular, 1-phenyl-5-mercatptotetrazole), mercaptopyrimidines, etc.; the foregoing heterocyclic mercapto compounds further having a water-soluble group such as a carboxy group and a sulfone group; thioketo compounds such as oxazolinethion; azaindenes such as tetraazaindenes (in particular, 4-hydroxy-substituted (1,3,3a,7) tetraazaindenes); benzenethiosulfonic acids; benzenesulfinic acids, etc.

Moreover, the silver halide photographic emulsion layers and other hydrophilic colloid layers of the photographic materials of this invention may contain various kinds of surface active agents as coating aids or for static prevention, for improving slidability, for improving the emulsified dispersion, for preventing adhesion, and for improving photographic properties (e.g., development acceleration, for increasing contrst, and sensitization).

As such surface active agents, there are nonionic surface active agents such as saponin (steroid series), alkylene oxide derivatives (e.g., polyethylene glycol, a polyethylene glycol/polypropylene glycol condensation product, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, polyethylene oxide adducts of silicone, etc.), glycidol derivatives (e.g., alkenylsuccinic acid polyglyceride, alkylphenol polyglyceride, etc.), fatty acid esters of polyhydric alcohols, alkyl esters of sugar, etc.; anionic surface active agents containing an acid group (e.g., a carboxy group, aulfo group, a phospho group, a sulfuric acid ester group, a phosphoric acid ester group, etc.), such as alkyl carboxylates, alkylsulfonates, alkylbenzenesulfonates, alkylnaphthalenesulfonates, alkylsulfuric acid esters, alkylphosphoric acid esters, N-acyl-N-alkyltaurins, sulfosuccinic acid esters, sufoalkylpolyoxyethylene alkylphenyl ethers, polyoxyethylenealkylphosphoric acid esters, etc.; amphoteric surface active agents such as amino acids, aminoalkylsulfonic acids, aminoalkylsulfuric acid esters, aminoalkylphosphoric acid esters, alkylbetains, amine oxides, etc.; and cationic surface active agents such as alkylamine salts, aliphatic or aromatic quaternary ammonium salts, heterocyclic quaternary ammonium salts (e.g., pyridinium, imidazolium, etc.), phosphonium or sulfonium salts containing aliphatic rings or heterocyclic rings, etc.

The silver halide photographic material of this invention may further contain in the silver halide emulsion layers polyalkylene oxide or the ether, ester or amine derivative thereof, a thioether compound, a thiomorphine, a quatery ammonium salt compound, a urethane derivative, a urea derivative, an imidazole derivative, a 3-pyrazolidone, etc., for the purpose of increasing the sensitivity, contrast, and development acceleration.

The photographic material of this invention may further contain a water-insoluble or water sparingly soluble synthetic polymer dispersion for improving the dimensional stability of the silver halide photographic emulsion layers and other hydrophilic colloid layers. Examples of the hydrophilic polymers are polymers or copolymers of alkyl acrylate or methacrylate (hereinafter, (meth)acrylate), alkoxyalkyl(meth)acrylate, glycidyl(meth)acrylate, (meth)acrylamide, a vinyl ester (e.g., vinyl acetate), acrylonitrile, an olefin, styrene, etc., singly or as a combination thereof, or a combination of the foregoing monomers and acrylic acid, methacrylic acid, $\alpha,\beta$-unsaturated dicarboxylic acid, hydroxyalkyl(meth)acrylate, sulfoalkyl(meth)acrylate, styrene-sulfonic acid, etc.

For the photographic processing of the silver halide photographic emulsion layers of the siver halide photographic materials of this invention, known processes and the known processing compositions, as described, for example, in *Research Disclosure,* No. 176, pages 28–30 (RD-17643) can be applied. The processing temperature is usually selected in the range of from 18° C. to 50° C., but the temperature may be lower than 18° C. or higher than 50° C. if desired.

In a specific embodiment of the development process for developing the photographic materials of this invention, a developing agent is incorporated in the photographic material, for example, the silver halide emulsion layer or layers and the photographic material may be processed in an alkaline aqueous solution. Among the developing agents, a hydrophobic developing agent can be incorporated in the silver halide emulsion layers by various methods, such as those described in *Research Disclosure,* No. 169 (RD-16928); U.S. Pat. No. 2,739,890; U.K. Pat. No. 813,253; or West German Pat. No. 1,547,763. Such a development process may be performed by a combination with a silver salt stabilization process by a thiocyanate.

As a fix solution for processing the photographic materials of this invention thus developed, a fix composition generally used can be employed. Examples of the fixing agent for use in the fix solution include a thiosulfate, a thiocyanate, as well as organic sulfur compounds having an effect as a fixing agent. The fix solution may further contain a water-soluble aluminum salt as a hardening agent.

For forming dye images, conventional processes can be applied. For example, there are a negative-positive process (described e.g., in *Journal of the Society of Motion Picture and Television Engineers,* Vol. 61, 667–701 (1953), etc.

The color developer which is used for developing the silver halide color photographic materials of this invention is generally an alkaline aqueous solution containing a color developing agent. The color developing agent for use in this invention includes known primary aromatic amine developers, for example, a phenylenediamine (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.).

The color developers for use in this invention can further contain pH buffers, developing inhibitors, antifoggants, etc. Also, the color developers may contain, if desired, water softeners, preservatives, organic solvents, development accelerators, dye-forming couplers, competing couplers, fogging agents, auxiliary developing agents, tackifiers, polycarboxylic acid series chelating agents, antioxidants, etc.

After color development, the photographic emulsion layers are usually subjected to bleach processing. The bleach process may be performed simultaneously with a fix process or may be performed separately. The bleaching agent includes a compound of a polyvalent metal such as iron (III), cobalt (III), chromium (VI), copper (II), etc., peroxides, quinones, nitroso compounds, etc.

For example, ferricyanides; dichromates; organic complex salts or iron (III) or cobalt (III), e.g., complex salts of aminopolycarboxylic acids such as ethylenediaminetetraacetic acid, nitrilotriacetic acid, 1,3-diamino-2-propanoltetraacetic acid, etc.; complex salts of organic acids such as citric acid, tataric acid, malic acid, etc.; persulfates, permangnates; nitrosophenol, etc. Among these compounds, potassium ferricyanide, ethylenediaminetetraacetic acid iron (III) sodium salt, and ethylenediaminetetraacetic acid iron (III) ammonium salt are particularly advantageous. The ethylenediaminetetraacetic acid iron (III) complex salts are useful in either an independent bleach solution or in a blix solution.

The silver halide photographic emulsions for use in this invention may be spectrally sensitized by methine dyes or other spectral sensitizing dyes. These sensitizing dyes may be used singly or as a combination of such dyes. A combination of sensitizing dyes is frequently used for the purpose of supersensitization. Specific examples of such sensitizing dyes are described, for example, in U.S. Pat. Nos. 2,688,545; 2,977,229; 3,397,060; 3,522,052; 3,527,641; 3,617,293; 3,628,964; 3,666,480; 3,672,898; 3,679,428; 3,814,609; 4,026,707; U.K. Pat. No. 1,344,281; Japanese Patent Publication No. 4,936/'68 and 12,375/'78, Japanese Patent Application (OPI) Nos. 110,618/'77 and 109,925/'77.

The present invention can be also applied to a multilayer multicolor photographic material having at least two silver halide photographic emulsion layers, having different spectral sensitivities, on a support. A multilayer natural color photographic material usually has at least one red-sensitive silver halide emulsion layer, at least one green-sensitive silver halide emulsion layer, and at least one blue-sensitive silver halide emulsion layer on a support. The positioning order of these emulsion layers may be optionally selected according to the particular purpose. Usually, the red-sensitive emulsion contains a cyan-forming coupler, the green-sensitive emulsion layer contains a magenta-forming coupler, and the blue-sensitive emulsion layer contains a yellow-forming coupler, but, as the case other combinations may be employed.

The silver halide photographic emulsion layers of the photographic materials of this invention may further contain color-forming couplers, that is, compounds each capable of coloring by oxidative coupling with the oxidation product of the primary aromatic amino developing agent (e.g., a phenylenediamine derivative or an aminophenol derivative) in a color development process. Examples of the magenta couplers that can be used in addition to those of the present invention include 5-pyrazolone couplers, pyrazolobenzimidazole couplers, cyanoacetylcumarone couplers, closed chain acyl-acetonitrile couplers, etc. Examples of the yellow couplers include acylacetamide couplers (e.g., benzoylacetanilide couplers, pivaloylacetanilide couplers, etc.). Also, examples of the cyan couplers are nephthol couplers, phenol couplers, etc.

As such couplers, non-diffusible couplers having a hydrophobic group called a "ballast group" in the molecule are preferred. The couplers may be of 4-equivalent or 2-equivalent to silver ion. Also, colored couplers having a color correction effect or so-called DIR couplers capable of releasing a development inhibitor with the progress of development may be used. Also, non-coloring DIR coupling compounds which form colorless products by coupling reaction and release development inhibitors may be used.

The photographic materials of this invention may further contain inorganic or organic hardening agents in the silver halide photographic emulsion layers or other hydrophilic colloid layers. Examples of such hardening agents include chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc. They may be used singly or as a combination thereof.

When dyes or ultraviolets absorbents are incorporated in the hydrophilic colloid layers of the photographic materials of this invention, these additives may be mordanted by cationic polymers.

The photographic materials of this invention may further contain hydroquinone derivatives, aminophenol derivatives, gallic acid derivatives, ascorbic acid derivatives, etc., as color fogging preventing agents.

The photographic materials of this invention may further contain ultraviolet absorbents in the hydrophilic colloid layers as described above. Examples of the ultraviolet absorbents are aryl-substituted benzotriazole compounds, 4-thiazolidone compounds, benzophenone compounds, cinnamic acid ester compounds, butadiene compounds, benzoxazole compounds, and polymers having ultraviolet absorbing property. These ultraviolet absorbents may be fixed in the foregoing hydrophilic colloid layers.

The photographic materials of this invention may further contain water-soluble dyes in the hydrophilic colloid layers as filter dyes or for various purposes such as irradiation prevention, etc. Examples of such dyes are oxonole dyes, hemioxonole dyes, styryl dyes, merocyanine dyes, cyanine dyes, and azo dyes. Among these dyes, oxonole dyes, hemioxonole dyes, and merocyanine dyes are particularly useful.

At the practice of this invention, the following fading preventing agents may be used. Examples of the fading preventing agent include hydroquinone derivatives, gallic acid derivatives, p-alkoxyphenols, p-oxyphenol derivatives, bisphenols, etc. They can be used singly or as a mixture thereof.

The following examples are further intended to illustrate the present invention, but not to limit it in any way.

EXAMPLE 1

In a mixture of 24 ml of tricresyl phosphate and 24 ml of ethyl acetate was dissolved 12 g of the magenta coupler (C-19) of this invention and the solution was dispersed by emulsification in 80 g of an aqueous gelatin solution containing 8 ml of a 1% aqueous solution of sodium dodecylbenzenesulfonate.

Then, the emulsified dispersion was mixed with 145 g (containing 7 g of Ag) of a green-sensitive silver chlorobromide emulsion (50 mole% bromine) and after adding thereto sodium dodecylbenzenesulfonate as a coating aid, the resultant mixture was coated on a paper support, both surfaces of which were coated with polyethylene. The coverage of the coupler in the coated emulsion layer was 488 mg/m$^2$. Then, a gelatin protective layer (1 g/m$^2$ of gelatin) was coated on the emulsion layer to provide Sample A.

By following the same procedure as in the case of preparing Sample A except that 10 mole% or 20 mole% (per mole of the coupler) of the metal complex (M—13) of this invention was added to the emulsified dispersion at the preparation thereof as shown in Table I, Samples B and C were prepared.

Furthermore, by following the same procedure as in the case of preparing Sample A except that in place of the coupler (C—19), the coupler (C—7), (C—24) and (C—32) respectively, were used in equimolar amounts to the coupler (C—19), Samples D, G and J were prepared.

Moreover, by following the same procedure as in the case of preparing Samples B and C, except that in place of the coupler (C—19), the couplers (C—7), (C—24) and (C—32), respectively, were used in equimolar amounts of that of the coupler (C—19), Samples F, H, and I were prepared.

Also, for comparison examples, by following the same procedures as in the cases of preparing Samples A, B, and C except that comparison coupler R having the structure shown below was used, in each case in an equivalent amount to that of the coupler (C—19) in place of the coupler (C—19), Samples M, N and O were prepared.

Comparison Coupler R

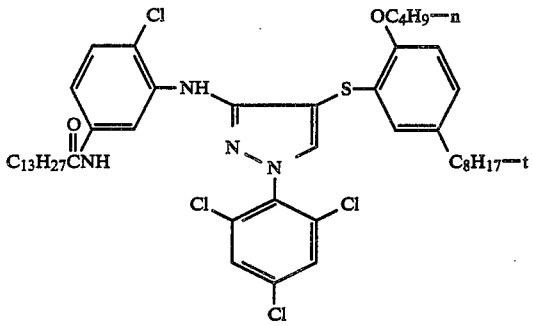

Each of Samples A to O thus prepared was imagewise exposed and then processed as follows.

| Processing step | Temperature | Time |
|---|---|---|
| Development | 33° C. | 3 min. 30 sec. |
| Blix | 33° C. | 1 min. 30 sec. |
| Wash | 28–35° C. | 3 min. |

The compositions of the processing liquids used for the above processing were as follows.

| Developer: | |
|---|---|
| Benzyl Alcohol | 15 ml |
| Diethylenetriamine Pentaacetate | 5 g |
| Potassium Bromide | 0.4 g |
| $Na_2SO_3$ | 5 g |
| $Na_2CO_3$ | 30 g |

-continued

| | |
|---|---|
| Hydroxyamine Sulfate | 2 g |
| 4-Amino-3-methyl-N—ethyl-N—β-(methanesulfonamido)ethylaniline.3/2$H_2SO_4$.$H_2O$ | 4.5 g |
| Water to make | 1000 ml |
| | pH 10.1 |
| Blix Solution: | |
| Ammonium Thiosulfate (70 wt %) | 150 ml |
| $Na_2SO_3$ | 5 g |
| Na[Fe(EDTA)] | 40 g |
| EDTA | 4 g |
| Water to make | 1000 ml |
| | pH 6.8 |

Each sample having a dye image thus formed was subjected to a fading test by means of a fluorescent lamp fademeter (illuminance of 15,000 lux) using a ultraviolet absorption filter cutting-off light having wavelengths shorter than 400 nm (made by Fuji Photo Film Co.) for 4 weeks.

The density measurement was performed by means of a Macbeth densitomer RD-514 (Status AA Filter) and the magenta density change in the portions having an initial density of 2.0 and an initial density of 1.0 and also the yellow density change in the white background portion were measured. The results are shown in Table I.

From the results shown in Table I, it can be seen that the metal complexes in this invention are effective for preventing the light-fading of magenta dye images formed of the 5-membered-5-membered condensed nitrogen heterocyclic type magenta couplers in this invention and do not cause yellow stains by light.

TABLE I

| Sample | Amount of metal complex (mole %) | Magenta density change (initial density of 2.0) | Magenta density change (initial density of 1.0) | Yellow density change (initial density of 0.03) |
|---|---|---|---|---|
| A* | 0 | −1.90 | −0.95 | +0.02 |
| B | 10 | −0.98 | −0.53 | +0.04 |
| C | 20 | −0.73 | −0.43 | +0.06 |
| D* | 0 | −1.45 | −0.68 | +0.02 |
| E | 10 | −0.24 | −0.25 | +0.04 |
| F | 20 | −0.18 | −0.17 | +0.04 |
| G* | 0 | −1.30 | −0.63 | +0.02 |
| H | 10 | −0.20 | −0.19 | +0.04 |
| I | 20 | −0.16 | −0.16 | +0.04 |
| J* | 0 | −1.73 | −0.76 | +0.03 |
| K | 10 | −0.44 | −0.31 | +0.04 |
| L | 20 | −0.25 | −0.22 | +0.04 |
| M* | 0 | −1.70 | −0.74 | +0.28 |
| N* | 10 | −0.22 | −0.21 | +0.17 |
| O* | 20 | −0.16 | −0.09 | +0.16 |

*Comparison Example
(non-marked): Example of this invention

EXAMPLE 2

By following the same procedure as in the case of preparing Sample B in Example 1 except that 10 or 20 mole % of the metal complex (M—21) was used in place of the metal complex (M—13), Samples 2B and 2C were prepared.

About each of Samples A (Example 1), 2B and 2C, the image exposure, processing, and fading test were applied as in Example 1. The results are as follows.

| Sample | Magenta density change (Initial density of 2.0) | Yellow density change (Initial density of 0.03) |
|---|---|---|
| A* | −1.91 | +0.02 |
| 2B | −0.90 | +0.03 |
| 2C | −0.67 | +0.03 |

*Comparison Example
(nonmarked): Examples of this invention

The effect of preventing the occurrence of stain and also preventing fading was observed about the metal complex (M—21).

EXAMPLE 3

Color photographic materials 3A to 30 were prepared by coating following 1st layer (undermost layer) to 6th layer (uppermost layer) on a paper support both surfaces of which were coated with polyethylene. In this case, as the coating liquid for the 3rd layer, each of the coating liquids used for preparing Samples A to O in Example 1 and the Sample 3A to 30 were denoted to the samples corresponding Samples A to O. Other silver halide emulsions were prepared according to the procedure as in Example 1.

Each of the samples was imagewise exposed and processed as in Example 1 and each sample having the dye image was tested for 3 days using a fluorescent lamp fade meter (20,000 lux). The results were almost the same as those in Example 1 and it was confirmed that the effect of this invention can also be obtained when the green-sensitive emulsion layer were coated with the blue-sensitive layer and the red-sensitive layer as multilayer color photographic materials.

The construction of the color photographic material was as follows.

Support: Paper support both surfaces of which were coated with polyethylene.

The 1st layer: Blue-sensitive silver chlorobromide emulsion layer (80 mole% Br, silver coverage of 400 mg/m$^2$) containing 700 mg/m$^2$ of gelatin, 500 gm/m$^2$ of a yellow coupler (*6), and 400 mg/m$^2$ of a coupler solvent (*7).

The 2nd layer: Interlayer containing 1000 mg/m$^2$ of gelatin.

The 3rd layer: Green-sensitive silver halide emulsion layer as in Example 1.

The 4th layer: Interlayer containing 800 mg/m$^2$ of gelatin, 600 mg/m$^2$ of a ultraviolet absorbent (*3), and 300 mg/m$^2$ of a ultraviolet absorbent solvent (*2).

The 5th layer: Red-sensitive silver chlorobromide emulsion layer (50 mole% Br, silver coverage of 300 mg/m$^2$) containing 500 mg/m$^2$ of gelatin, 400 mg/m$^2$ of a cyan coupler (*1), and 300 mg/m$^2$ of a coupler solvent (*2).

The 6th layer: Protective layer containing 1600 mg/m$^2$ of gelatin.

*1: Cyan coupler: 2-[α-(2,4-Tert-pentylphenoxy)butan amido]-4,6-dichloro-5-methylphenol.
*2: Solvent: Dibutyl Phthalate.
*3: Ultraviolet Absorbent: 2-(2-Hydroxy-3-sec-butyl-5-tert-butylphenyl)benzotriazole.
*6: Cyan Color Coupler: α-Pivaloyl-α-(2,4-dioxo-3-yl)-2-chloro-5-[α-(2,4-di-tert-pentylphenoxy)butanamido]acetanilide.
*7: Solvent: Dioctylbutyl phosphate While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least a silver halide photographic layer, and photographic material contains (1) at least one magenta coupler selected from the group consisting of (i) compounds represented by following formulae (VI), (VII), (IX) and (X) and (2) at least one metal complex selected from the group consisting of compounds represented by following formula (II), (III), (IV) and (V):

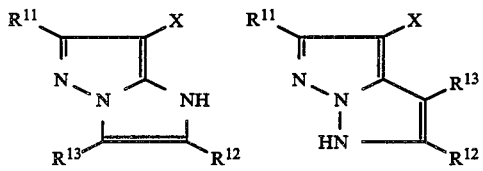

(VI)

(VII)

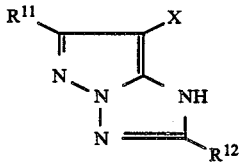

(IX)

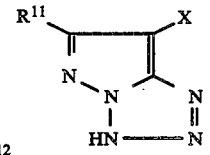

(X)

wherein $R^{11}$, $R^{12}$ and $R^{13}$ each represent a hydrogen atom, a halogen atom, an alkyl group, an aryl group, a heterocyclic ring group, a cyano group, an alkoxy group, an aryloxy group, a heterocyclicoxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group and substituted groups thereof, and X represents a hydrogen atom, a halogen atom, a carboxy group, or a coupling releasable group bonded to the carbon atom at a coupling position through an oxygen atom, a nitrogen atom or a sulfur atom or $R^{12}$ and $R^{13}$ combine with each other to form a 5-, 6- or 7-membered nonaromatic ring, or $R^{12}$ and $R^{13}$ in the coupler shown by formula (VII) combined with each other to form 5-, 6- or 7-membered saturated, unsaturated or aromatic ring; (ii) bis compounds containing coupler moieties derived from the above-described formulae wherein $R^{11}$, $R^{12}$, $R^{13}$ or X represents a bond or a divalent group and forms a bis compound, (iii) a polymer coupler of a monomer-containing coupler moiety derived from at least one compound represented by the above-described formulae wherein $R^{11}$, $R^{12}$, $R^{13}$ or X represents a vinyl group or a substituent having a vinyl group through a linkage group, said vinyl group being substituted or unsubstituted with the coupler moiety derived from formula (VI), (VII), (IX) or (X), a chlorine atom or a lower alkyl group having 1 to 4 carbon atoms, and (iv) a copolymer obtained from a monomer containing at least one coupler moiety selected from the group consisting of moieties derived from above-described formulae wherein $R^{11}$, $R^{12}$, $R^{13}$ or X represents a vinyl group or a substituent having a vinyl group through a linkage group, said vinyl group being unsubstituted or substituted with the coupler moiety derived from formula (VI), (VII), (IX) or (X), a chlorine atom, or a lower alkyl group having 1 to 4 carbon atoms, and a non-coloring ethylenic monomer which does not cause coupling with the oxidation product of a primary aromatic amine color developing agent (II)

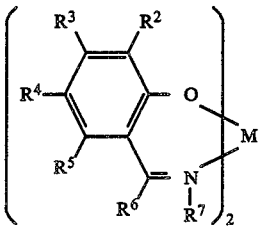

(III)

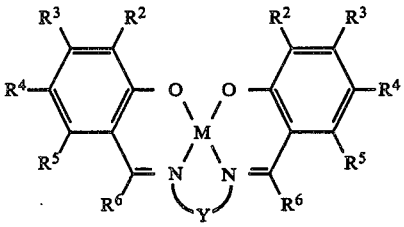

(IV)

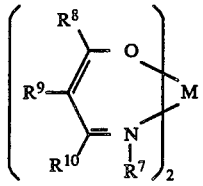

(V)

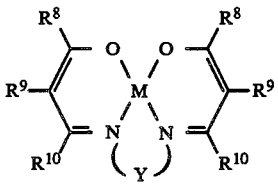

wherein

M represents Cu, Co, Ni, Pd or Pt; $R^2$, $R^3$, $R^4$ and $R^5$ each represents a hydrogen atom, a halogen atom, a hydroxy group, a cyano group, or an alkyl, aryl, cycloalkyl, or heterocyclic group each bonded to a carbon atom of the benzene ring directly or through a divalent linking group; or $R^2$ and $R^3$, $R^3$ and $R^4$, or $R^4$ and $R^5$ combine with each other to form a nonmetallic atomic group necessary for forming a 6-membered ring;

$R^6$, $R^9$ and $R^{10}$ each represents a hydrogen atom, an alkyl group, or an aryl group;

$R^7$ represents a hydrogen atom, an alkyl group, an aryl group, or a hydroxy group;

$R^8$ represents an alkyl group or an aryl group; or $R^8$ and $R^9$, or $R^9$ and $R^{10}$ combine with each other to form a nonmetallic atomic group forming a 5-, 7-, or 8-membered ring; and Y represents a nonmetallic atomic group forming a 5- or 6-membered ring.

2. A silver halide color photographic material as claimed in claim 1, wherein said at least one magenta coupler is represented by formula (VI).

3. A silver halide color photographic material as claimed in claim 1, wherein said at least one magenta coupler is represented by formula (VII).

4. A silver halide color photographic material as claimed in claim 1, wherein said at least one magenta coupler is represented by formula (IX).

5. A silver halide color photographic material as claimed in claim 1, wherein said at least one magenta coupler is represented by formula (X).

6. A silver halide color photographic material as in claim 1, wherein $R^2$, $R^3$, $R^4$ and $R^5$ each represents a substituted or unsubstituted, straight or branched chain alkyl group having from 1 to 19 caron atoms, in the alkyl moiety, a substituted or unsubstituted aryl group having from 6 to 14 carbon atoms in the aryl moiety, a substituted or unsubstituted 5-membered or 6-membered heterocyclic ring, a substituted or unsubstituted 5-membered or 6-membered cycloalkyl group, or $R^2$ and $R^3$, $R^3$ and $R^4$ or $R^4$ and $R^5$ combine with each other to form a substituted or unsubstituted benzene ring, naphthalene ring, isobenzothiophene ring, isobenzofuran ring, or isoindoline ring.

7. A silver halide color photographic material as in claim 1, wherein $R^2$, $R^3$, $R^4$ and $R^5$ each represents a substituted or unsubstituted, straight or branched chain alkyl group having from 1 to 19 carbon atoms in the alkyl moiety, a substituted or unsubstituted aryl group having from 6 to 14 carbon atoms in the aryl moiety, a substituted or unsubstituted 5-membered or 6-membered heterocyclic ring, or a substituted or unsubstituted 5-membered or 6-membered cycloalkyl group, all of said groups being bonded to the carbon atom of the benzene ring through a divalent linkage group selected from the group consisting of an oxy (—O—) group, a thio (—S—) group, a divalent linking group derived from an amino group, a carbamoyl group, a sulfamoyl group, or a carbonylamino group, an oxycarbonyl group, a carbonyl group, a sulfonyl group, and a carbonyloxy group.

8. A silver halide color photographic material as in claim 1, wherein $R^6$, $R^7$, $R^8$, $R^9$ and $R^{10}$ each represents a substituted or unsubstituted, straight or branched chain alkyl group having from 1 to 20 carbon atoms in the alkyl moiety, and a substituted or unsubstituted aryl group having from 6 to 14 carbon atoms in the aryl moiety.

9. A silver halide color photographic material as in claim 1, wherein said nonmetallic atomic group is selected from the group consisting of atomic groups represented by formulae (a), (b), (c), (d) and (e);

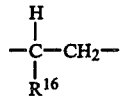
(a)

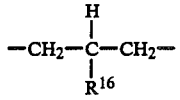
(b)

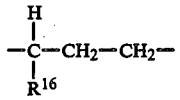
(c)

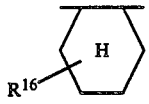
(d)

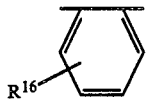
(e)

wherein $R^{16}$ represents a hydrogen atom or an alkyl group.

10. A silver halide color photographic material as in claim 9 wherein $R^{16}$ represents a substituted or unsubstituted straight and branched chain alkyl group having from 1 to 20 carbon atoms in the alkyl moiety.

11. A silver halide color photographic material as in claim 1, wherein said metal complex is selected from the group consisting of compounds represented by formulae (IIa), (IIb), (IIIa), (IVa), (IVb) and (Va);

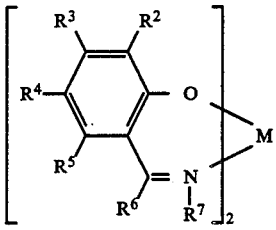
(IIa)

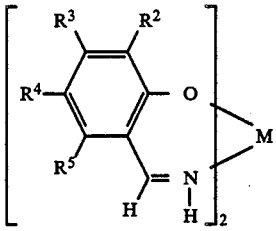
(IIb)

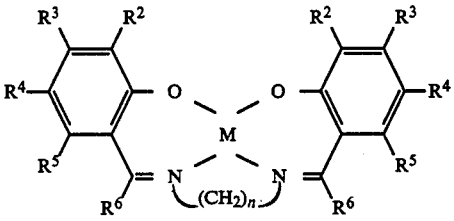
(IIIa)

-continued (IVa)

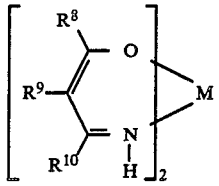

(IVb)

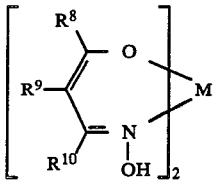

(Va)

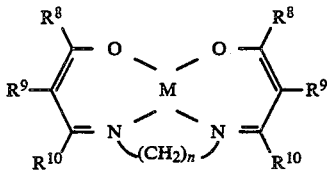

wherein $R^2$, $R^3$, $R^4$, $R^5$, $R^6$ and $R^7$ are defined as in claim 1, and $R^{17}$ represents an alkyl group or an aryl group which are defined as in claim 1.

12. A silver halide color photographic material as in claim 11, wherein said metal complex is selected from the group consisting of compounds represented by formula (IIa), (IIb) or (IIIa) and $R^2$ is a group capable of causing hydrogen bonding, at least one of $R^3$, $R^4$, and $R^5$ is a hydrogen atom, a hydroxy group, an alkyl group or an alkoxy group, and the total carbon number of the groups represented by $R^2$, $R^3$, $R^4$, $R^5$, $R^6$ and $R^7$ is at least 4.

13. A silver halide color photographic material as in claim 12, wherein said group capable of causing hydrogen bonding is a group selected from the group consisting of an oxy group-containing group, a thio group-containing group, a carbonyl group-containing group, an oxycarbonyl group-containing group, a carbamoyl group, a sulfamoyl group, a sulfonyl group-containing group, a sulfonylamino group, an acylamino group, a carbonyloxy group-containing group, an amino group, a hydroxy group, a nitro group, a cyano group, a carboxylic acid group, a sulfonic acid group, and a halogen atom.

14. A silver halide color photographic material as in claim 1, wherein said magenta coupler is incorporated in the silver halide photographic layer in an amount of from $2\times10^{-3}$ mole to $5\times10^{-1}$ mole per mole of silver in the layer.

15. A silver halide color photographic material as in claim 1, wherein said metal complex is incorporated in the photographic material in an amount of from 1 to 100 mole% per mole of the coupler.

16. A silver halide color photographic material as in claim 1, wherein said magenta coupler is incorporated in a silver halide emulsion layer.

17. A silver halide color photographic material as in claim 16 wherein said silver halide emulsion layer is a green-sensitive silver halide emulsion layer.

18. A silver halide color photographic material as in claim 1, wherein said metal complex is incorporated in a layer wherein the magenta coupler is incorporated.

* * * * *